US012590437B2

(12) United States Patent
Young

(10) Patent No.: US 12,590,437 B2
(45) Date of Patent: Mar. 31, 2026

(54) SYSTEMS AND METHODS OF PROVIDING RIDE CONTROL WITH A POWER MACHINE

(71) Applicant: Doosan Bobcat North America, Inc., West Fargo, ND (US)

(72) Inventor: Christopher Young, Fargo, ND (US)

(73) Assignee: Doosan Bobcat North America, Inc., West Fargo, ND (US)

( * ) Notice: Subject to any disclaimer, the term of this patent is extended or adjusted under 35 U.S.C. 154(b) by 53 days.

(21) Appl. No.: 18/785,876

(22) Filed: Jul. 26, 2024

(65) Prior Publication Data

US 2025/0034834 A1 Jan. 30, 2025

Related U.S. Application Data

(60) Provisional application No. 63/515,626, filed on Jul. 26, 2023.

(51) Int. Cl.

| | |
|---|---|
| ***E02F 3/43*** | (2006.01) |
| ***E02F 3/34*** | (2006.01) |
| ***E02F 9/20*** | (2006.01) |

(52) U.S. Cl.

CPC ..... *E02F 3/432* (2013.01); *E02F 3/3414* (2013.01); *E02F 9/2095* (2013.01)

(58) Field of Classification Search

CPC ..... E02F 3/432; E02F 3/3414; E02F 9/2095; E02F 3/431; E02F 9/2207; E02F 9/264; E02F 9/207

See application file for complete search history.

(56) References Cited

U.S. PATENT DOCUMENTS

| | | | | |
|---|---|---|---|---|
| 6,766,236 | B1 | 7/2004 | Lamela et al. | |
| 9,694,861 | B2 | 7/2017 | Thomas et al. | |
| 10,355,554 | B2 | 7/2019 | Parmar et al. | |
| 10,494,790 | B2 | 12/2019 | Duppong et al. | |
| 11,618,324 | B2 * | 4/2023 | Sosnowski | B60L 1/003 180/65.31 |
| 2006/0254840 | A1 | 11/2006 | Strong | |
| 2006/0254841 | A1 | 11/2006 | Strong | |
| 2017/0240397 | A1 | 8/2017 | Eaglestone | |

(Continued)

FOREIGN PATENT DOCUMENTS

WO 2016176547 A1 11/2016

OTHER PUBLICATIONS

International Searching Authority, International Search Report and Written Opinion issued for corresponding International App. No. PCT/US2024/039824, mailed Nov. 11, 2024 [14 pgs].

*Primary Examiner* — Thomas Ingram
(74) *Attorney, Agent, or Firm* — Quarles & Brady LLP

(57) ABSTRACT

Automated operation methods and systems are provided for power machines. One system includes implementing ride control for an electric power machine. The system may include an electronic processor configured to determine a target lift position and an initial electric current for holding a load at the target lift position. The electronic processor may also be configured to determine, based on a positional deviation of the load from the target lift position, an updated electric current for returning the load to the target lift position. The electronic processor may also be configured to control an electric lift actuator to return the load to the target lift position using the updated electric current.

20 Claims, 13 Drawing Sheets

(56) References Cited

U.S. PATENT DOCUMENTS

| | | | | |
|---|---|---|---|---|
| 2018/0163364 | A1 | 6/2018 | Huisoon | |
| 2021/0261393 | A1 | 8/2021 | Imaoka et al. | |
| 2021/0270004 | A1* | 9/2021 | Durkin | E02F 9/0858 |
| 2022/0243425 | A1* | 8/2022 | Peterson | E02F 9/265 |
| 2022/0374011 | A1* | 11/2022 | Moeller | E02F 9/2004 |
| 2023/0104698 | A1* | 4/2023 | Young | E02F 9/207 701/22 |
| 2023/0189686 | A1* | 6/2023 | Young | E02F 9/24 701/50 |

* cited by examiner

1000

1200

| Lift Actuator Position (inches) | No load Current (amps) | Empty bucket (500 lbs.) Current (amps) | 3000 lbs. Current (amps) | 4500 lbs. Current (amps) |
|---|---|---|---|---|
| .25 | | | | |
| 0.5 | | | | |
| 1.0 | | | | |
| 2.0 | 4.94 | 11.27 | 19.75 | 25.05 |
| 3.0 | 4.94 | 11.68 | 19.75 | 25.95 |
| 4.0 | 7.34 | 14.50 | 29.35 | |
| 5.0 | 7.51 | 17.46 | 30.05 | 38.80 |
| 6.0 | 7.48 | 17.82 | 29.90 | 39.60 |
| 7.0 | 7.83 | 18.34 | 31.30 | 40.75 |
| 8.0 | 7.84 | 18.23 | 31.35 | 40.50 |
| 9.0 | 7.80 | 18.36 | 31.20 | 40.80 |
| 10.0 | 8.00 | 18.23 | 32.00 | 40.50 |
| 11.0 | 7.55 | 17.98 | 30.20 | 39.95 |
| 12.0 | 7.43 | 17.62 | 29.70 | 39.15 |
| 13.0 | 7.01 | 17.24 | 28.05 | 38.30 |
| 14.0 | 6.98 | 16.54 | 27.90 | 36.75 |
| 15.0 | 6.76 | 15.98 | 27.05 | 35.50 |
| 16.0 | 6.51 | 15.39 | 26.05 | 34.20 |
| 17.0 | 6.36 | 14.90 | 25.45 | 33.10 |
| 18.0 | 6.09 | 14.22 | 24.35 | 31.60 |
| 19.0 | 5.75 | 13.77 | 23.00 | 30.60 |
| 20.0 | 5.68 | 13.30 | 22.70 | 29.55 |
| 21.0 | 5.56 | 12.98 | 22.25 | 28.85 |
| 22.0 | 5.44 | 12.67 | 21.75 | 28.15 |
| 23.0 | 5.38 | 12.83 | 21.50 | 28.50 |
| 24.0 | 5.61 | 13.30 | 22.45 | 29.55 |
| 25.0 | 6.06 | 14.41 | 24.25 | 32.05 |
| 26.0 | 8.48 | 19.53 | 33.90 | 43.40 |

FIG. 12

SYSTEMS AND METHODS OF PROVIDING RIDE CONTROL WITH A POWER MACHINE

CROSS-REFERENCE TO RELATED APPLICATIONS

This application claims the benefit of and priority to U.S. Provisional Application No. 63/515,626, filed Jul. 26, 2023, the entirety of which is incorporated by reference herein.

BACKGROUND

This disclosure is directed toward power machines. More particularly, the present disclosure is directed to power machines that operate in whole or in part under electrical power. Power machines, for the purposes of this disclosure, include any type of machine that generates power for the purpose of accomplishing a particular task or a variety of tasks. One type of power machine is a work vehicle. Work vehicles, such as loaders, are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

The discussion above is merely provided for general background information and is not intended to be used as an aid in determining the scope of the claimed subject matter.

SUMMARY OF THE DISCLOSURE

Power machines, such as skid-steers, compact track loaders, etc., experience external forces when traversing a terrain (especially a rough terrain). Such external forces may result in spilling a load of the implement, loss of tractive element contact with a ground surface, shaking of the operator, etc. For example, a loaded bucket may "buck" in response to traversing rough terrain. Accordingly, it can be advantageous to mitigate or dampen external forces that the power machine experiences when traversing a terrain, such as a rough terrain.

Ride control is a feature that allows a workgroup actuator (e.g., a lift arm actuator, a tilt actuator, etc.) to operate in a damping capacity in response to external forces imposed on a power machine by travel over terrain. In particular, ride control can allow a lift arm—and a load held thereby—to move independently of the chassis of the power machine as travel over terrain results in imposition of external forces on the lift arm- and the load. This generally provides a smoother ride for the operator of the power machine. In contrast, when ride control is not active, the lift assembly (or components thereof) generally resists any movement of the work group relative to the chassis, which may result in the external forces adversely impacting the performance of the power machine, and the user experience of the operator of the power machine.

Some configurations of the disclosure are directed to implementing ride control (a ride control mode) for power machines such that a work group of the power machine operates in a damping capacity, and, in particular, to providing ride control for electric power machines. Configurations described herein facilitate automated ride control for electric power machines. Accordingly, the technology disclosed herein may provide an advantageous control scheme that enables ride control on an electric power machine with electric lift actuators.

In some examples, ride control may be implemented to maintain (or return to) a target lift position for a lift assembly, including, e.g., a work element supported by the lift assembly, as the power machine traverses terrain such that an actual (or present) lift position for the lift assembly may deviate from that target lift position in response to the external forces from traversing the terrain. Using position related information, the technology disclosed herein may maintain (or return to) a target lift position based on a deviation from the target lift position caused by external forces on the power machine (e.g., the lift assembly or a component thereof).

In particular, some configurations allow a lift arm to move under its own inertia, or the inertia of a load carried by the lift arm (as opposed to holding a lift arm at a zero velocity and rigid to the power machine). For example, rather than a power machine holding a load using velocity (e.g., controlling an actuator to enforce zero velocity) the load may be held using force control. For example, when the desired position of the load is known, forces applied to the load by an actuator can be increased or decreased to hold the lift position of the load near the desired lift position (e.g., the target lift position), but not rigidly so. In particular, When the power machine traverses terrain, the position of the load may be allowed to vary to compensate for external forces from the terrain, and the force necessary to move the load back to the desired lift position can be controlled accordingly.

In some cases, limiting the force used to hold the load may also limit the accelerations the load may experience, which can give the operator a smoother ride because the load is not rigidly held. Correspondingly, in some cases, acceleration of the load relative to the power machine chassis can be measured and, hence, the force needed to move the load back to the desired position, at a given speed and acceleration, can be calculated. When using an electric actuator to control force, the electric current in the actuator motor is generally proportional to the force the actuator outputs. Therefore, to control the force output by the electric actuator, some configurations control the electric current of the actuator motor, such that the lift assembly maintains or returns to a target lift position.

Some configurations of the present disclosure provide a system for controlling an electric power machine. The system may include one or more electronic processors in electrical communication with an electric lift actuator of a lift assembly of the electric power machine. The one or more electronic processors may be configured to receive operational data for the electric power machine. The one or more electronic processors may be configured to determine, based on the operational data, a target lift position for the electric lift actuator. The one or more electronic processors may be configured to determine, based on the operational data, an initial electric current of the electric lift actuator corresponding to the target lift position. The one or more electronic processors may be configured to determine, based on the operational data, a present lift position of the electric lift actuator. The one or more electronic processors may be configured to determine an updated electric current for the electric lift actuator based on the target lift position, the initial electric current, and the present lift position. The one or more electronic processors may be configured to control the electric lift actuator using the updated electric current, to maintain or return to the target lift position while the electric power machine performs a tractive operation.

Some configurations described herein provide a method of controlling an electric power machine. The method may include, upon activation of a ride control mode for the electric power machine, determining, with one or more electronic processors, a target lift position for a lift assembly of the electric power machine; determining, with the one or more electronic processors, an initial electric current of the lift assembly for the target lift position; and determining, with the one or more electronic processors, a present lift position of the lift assembly. The method may also include determining, with the one or more electronic processors, an updated electric current for an electric lift actuator of the lift assembly, based on the target lift position, the initial electric current, and the present lift position; and controlling, with the one or more electronic processors, the electric lift actuator using the updated electric current to maintain the target lift position.

Some configurations described herein provide an electric power machine. The electric power machine may include a frame. The electric power machine may also include a plurality of electric actuators supported by the frame, wherein the plurality of electric actuators includes an electric lift actuator. The electric power machine may also include a lift arm structure. The lift arm structure may include a lift arm coupled to the frame and configured to be moved relative to the frame by the electric lift actuator. The electric power machine may also include an electric power source configured to power the plurality of electric actuators. The electric power machine may also include one or more electronic processors in communication with the plurality of electric actuators. The one or more electronic processors may be configured to monitor operational data for the electric power machine, the operational data may include data associated with a first control parameter and a second control parameter. The one or more electronic processors may be configured to control the electric lift actuator using a first control parameter when a first operation mode is active. The one or more electronic processors may be configured to detect activation of a ride control mode for maintaining or returning to a target lift position during tractive operations. The one or more electronic processors may be configured to, responsive to activation of the ride control mode for the electric power machine, control the electric lift actuator to maintain or return to the target lift position using the second control parameter while the electric power machine performs a tractive operation, the second control parameter being different from the first control parameter.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

BRIEF DESCRIPTION OF THE DRAWINGS

The following drawings are provided to help illustrate various features of examples of the disclosure and are not intended to limit the scope of the disclosure or exclude alternative implementations.

FIG. 12 is a table of electric current measurements for various loads at different lift positions according to some configurations.

DETAILED DESCRIPTION OF THE PRESENT DISCLOSURE

Figure 1:
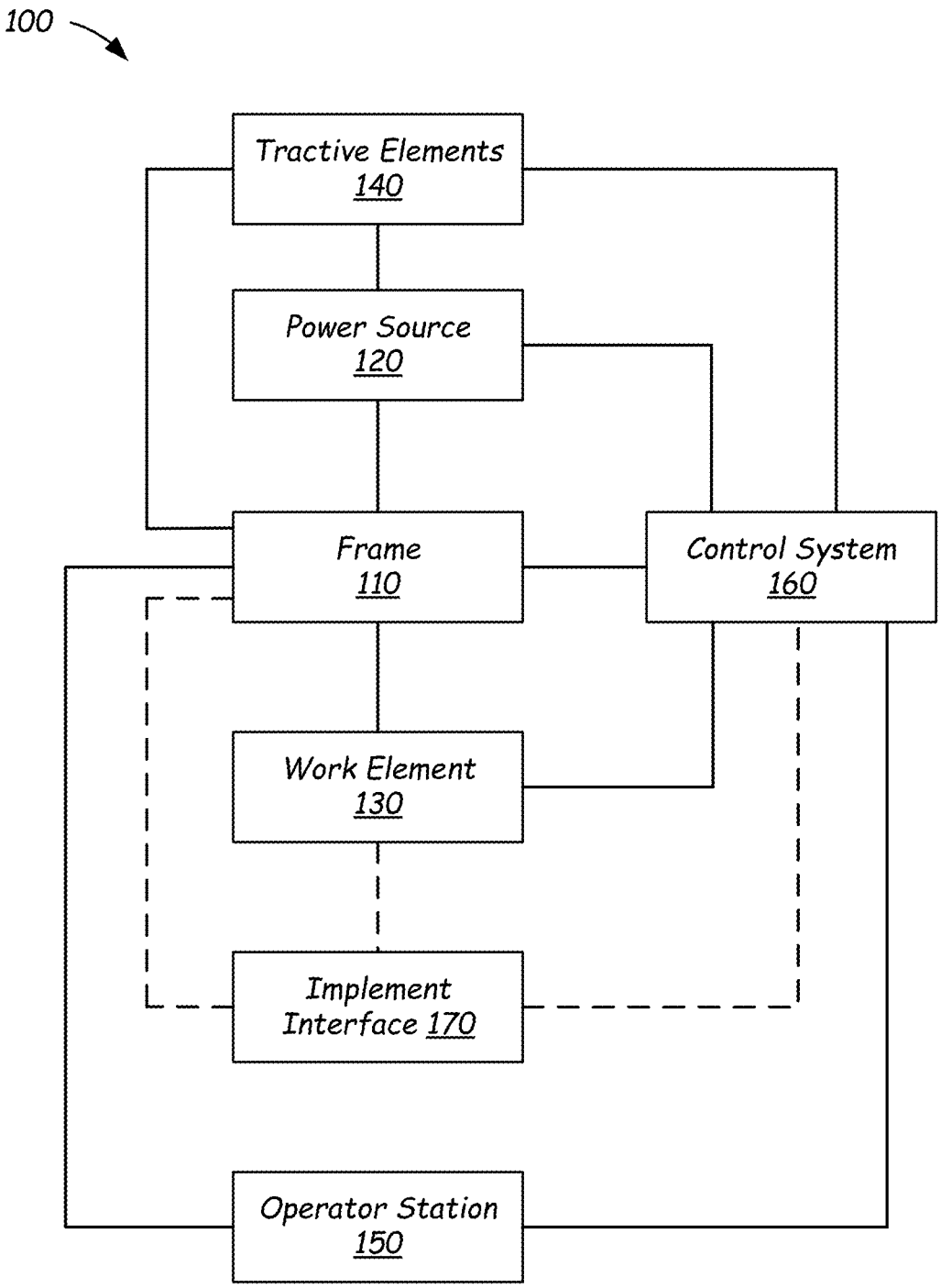
FIG. 1 is a block diagram illustrating functional systems of a representative power machine on which configurations of the present disclosure can be advantageously practiced.

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

While the power machines disclosed herein may be embodied in many different forms, several specific embodiments are discussed herein with the understanding that the embodiments described in the present disclosure are to be considered only exemplifications of the principles described herein, and the technology disclosed herein is not intended to be limited to the embodiments illustrated.

Some discussion below describes improved components and configurations for power machines, including components and configurations that use electrical (e.g., as opposed to hydraulic) power to operate certain power machine components or otherwise implement certain power machine functionality. In some configurations, electrically powered components can be mounted to a frame of a power machine to selectively move work elements of the power machine, including lift arms or implement carriers. In some configurations, electrically powered components can provide motive power for a power machine, including for tracked power machines (e.g., compact tracked loaders).

The technology disclosed herein relates to electric power machines, including automated operation of electric power machines. In particular, the technology disclosed herein relates to systems and methods of controlling a lift position for a lift assembly of a power machine to provide improved ride control. For example, implementations of the disclosed technology can be used while the power machine performs tractive operations to return a work element (e.g., an attached implement) to a present lift position after departure from that position due to external forces (or to maintain that present lift position, as appropriate). This can be particularly useful, for example, to mitigate or dampen external forces experienced by the power machine (or operator thereof) while traversing terrain, such that the operator experiences a smoother ride. Additionally, some configurations disclosed herein may also reduce (e.g., eliminate) spilling of a load of the implement, loss of tractive element contact with a ground surface, shaking of the operator, etc. As further detailed below, various control methods and system configurations can be used to facilitate automated ride control for various types of work elements, including for electric actuators of electric power machines in particular.

In some examples, ride control may be implemented to change a lift position of a lift assembly during tractive operations, to correspondingly control a position of a work element supported by the lift assembly. For example, some implementations can permit an initial change of an extension length of a lift actuator from an initial position, in response to external forces, then control the extension length of the lift actuator to return the lift arm to a target lift position (e.g., the initial position) as the power machine (and the lift assembly) experiences external forces caused by the power machine traversing terrain. Thus, for example, a bucket or other implement can be allowed to move in reaction to the external forces (e.g., via movement of a supporting lift arm independently of the chassis of the power machine) and then be automatically returned to a target lift position in response to the reactive movement.

In some examples, the technology disclosed herein may implement ride control using an electric current control scheme (e.g., as opposed to a velocity control scheme). When using an electric actuator to control force, the electric current in the electric actuator is generally proportional to the force the electric actuator outputs. Therefore, to control the force output by the electric actuator, some configurations control the electric current of the actuator motor to provide a particular force as opposed to providing a particular velocity (e.g., zero velocity, to hold position of a lift arm). Accordingly, in response to transient forces induced by movement over terrain, a lift arm can be allowed move away from a starting position and then can be automatically returned to a target lift position.

In this regard, some configurations may determine the electric current of the electric actuator based on a target lift position for the electric lift actuator, an initial (or starting) electric current of the electric actuator upon activation of a ride control mode, and a present lift position of the electric lift actuator. For example, an initial electric current can be provided to hold a load against gravity, in an initial position, with a particular force. The load can then be permitted to move away from an initial position in response to an increase in external forces (e.g., rather than being maintained rigidly via velocity control). Upon movement away from the initial position, the electric current can then be increased accordingly, to gradually return the lift arm to the initial position (e.g., with increased electric current being provided with increasing deviation from the initial position).

Figure 2:
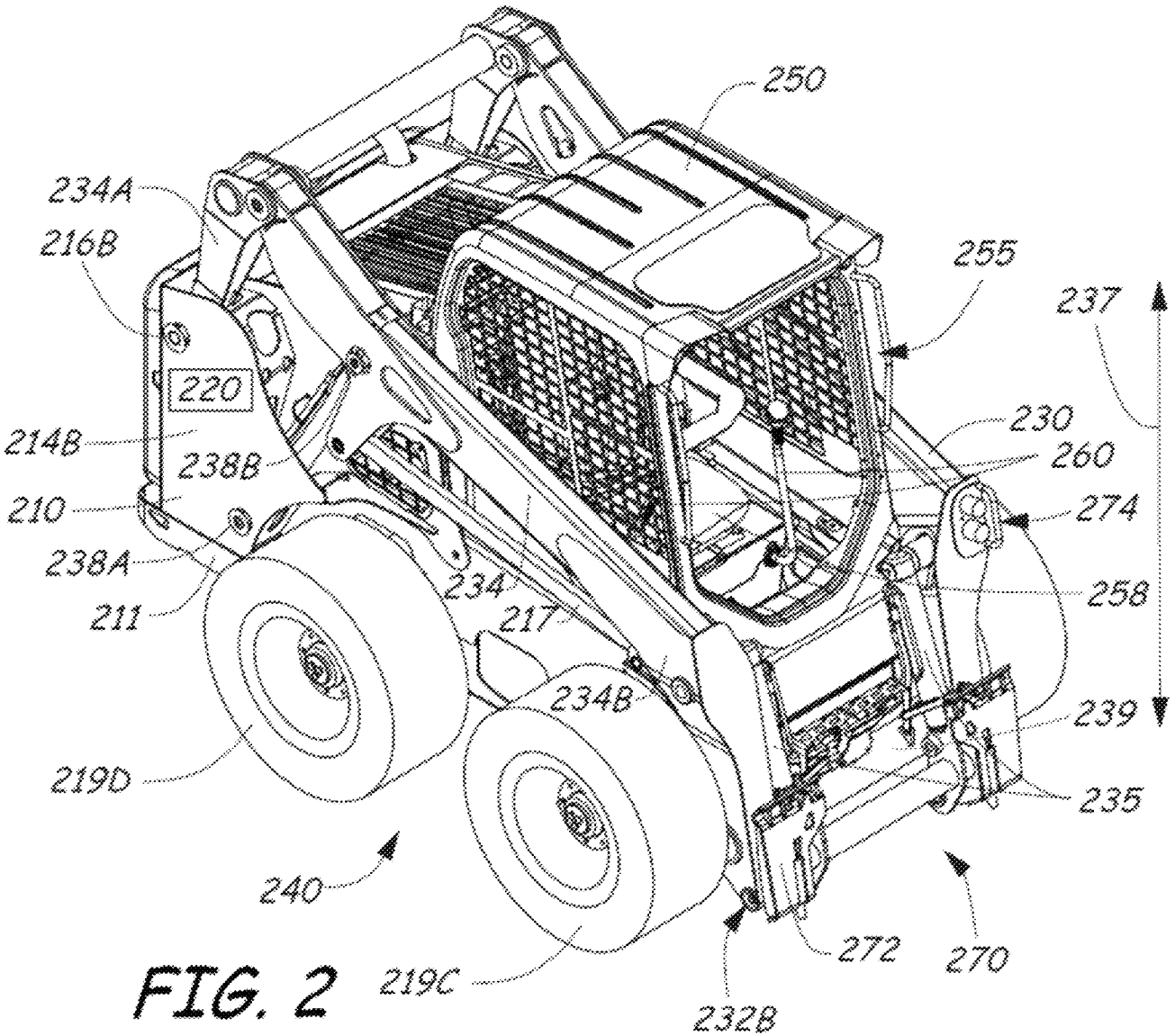
FIG. 2 is a perspective view showing generally a front of a power machine on which configurations disclosed in this specification can be advantageously practiced.
Figure 3:
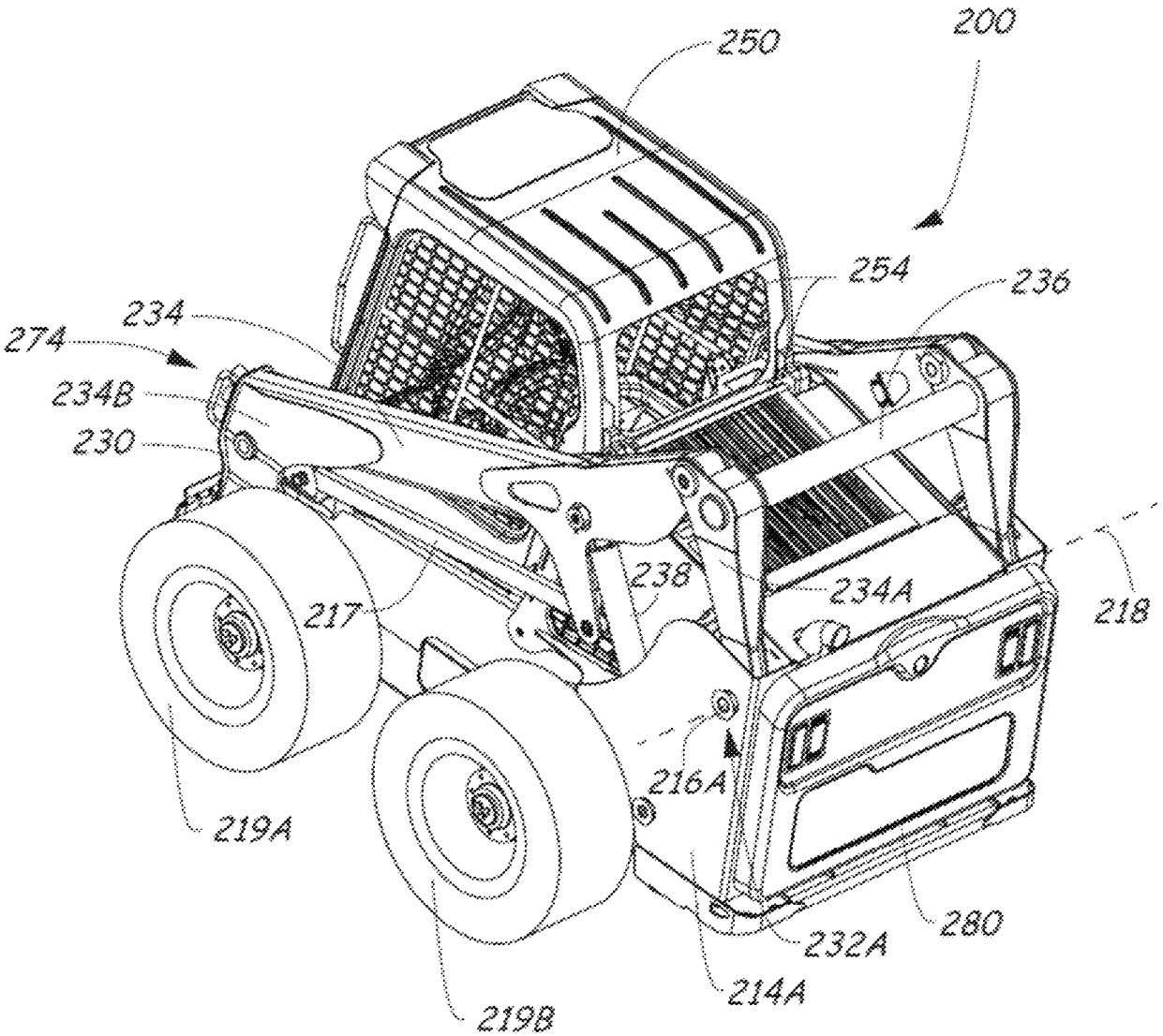
FIG. 3 is a perspective view showing generally a back of the power machine shown in FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is illustrated and discussed as being a representative power machine. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

FIG. 1 is a block diagram that illustrates the basic systems of a power machine 100, which can be any of a number of different types of power machines, upon which the embodiments discussed below can be advantageously incorporated. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, i.e., the lift arm can be manipulated to position the implement to perform the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of different implements to the work element. One characteristic of such an implement carrier is that once an implement is attached to it, it is fixed to the implement (i.e., not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is configured to provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electric sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. For example, the power machine can be a mower with a mower deck or other mower component as a work element, which may be movable with respect to the frame of the mower. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 includes an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e., from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e., remote from both of the power machine and any implement to which is it coupled) that is capable of controlling at least some of the operator-controlled functions on the power machine.

FIGS. 2-3 illustrate a loader 200, which is one particular example of a power machine of the type illustrated in FIG. 1 where the embodiments discussed below can be advantageously employed. Loader 200 is a skid-steer loader, which is a loader that has tractive elements (in this case, four wheels) that are mounted to the frame of the loader via rigid axles. Here the phrase "rigid axles" refers to the fact that the skid-steer loader 200 does not have any tractive elements that can be rotated or steered to help the loader accomplish a turn. Instead, a skid-steer loader has a drive system that independently powers one or more tractive elements on each side of the loader so that by providing differing tractive signals to each side, the machine will tend to skid over a support surface. These varying signals can even include powering tractive element(s) on one side of the loader to move the loader in a forward direction and powering tractive element(s) on another side of the loader to mode the loader in a reverse direction so that the loader will turn about a radius centered within the footprint of the loader itself. The term "skid-steer" has traditionally referred to loaders that have skid steering as described above with wheels as tractive elements. However, it should be noted that many track loaders also accomplish turns via skidding and are technically skid-steer loaders, even though they do not have wheels. For the purposes of this discussion, unless noted otherwise, the term skid-steer should not be seen as limiting the scope of the discussion to those loaders with wheels as tractive elements. Correspondingly, although some example power machines discussed herein are presented as skid-steer power machines, some embodiments disclosed herein can be implemented on a variety of other power machines. For example, some embodiments can be implemented on compact loaders or compact excavators that do not accomplish turns via skidding.

Loader 200 is one particular example of the power machine 100 illustrated broadly in FIG. 1 and discussed above. To that end, features of loader 200 described below include reference numbers that are generally similar to those used in FIG. 1. For example, loader 200 is described as having a frame 210, just as power machine 100 has a frame 110. Skid-steer loader 200 is described herein to provide a reference for understanding one environment on which the embodiments described below related to track assemblies and mounting elements for mounting the track assemblies to a power machine may be practiced. The loader 200 should not be considered limiting especially as to the description of features that loader 200 may have described herein that are not essential to the disclosed embodiments and thus may or may not be included in power machines other than loader 200 upon which the embodiments disclosed below may be advantageously practiced. Unless specifically noted otherwise, embodiments disclosed below can be practiced on a variety of power machines, with the loader 200 being only one of those power machines. For example, some or all of the concepts discussed below can be practiced on many other types of work vehicles such as various other loaders, excavators, trenchers, and dozers, to name but a few examples.

Loader 200 includes frame 210 that supports a power system 220, the power system being capable of generating or otherwise providing power for operating various functions on the power machine. Power system 220 is shown in block diagram form but is located within the frame 210. Frame 210 also supports a work element in the form of a lift arm assembly 230 that is powered by the power system 220 and that can perform various work tasks. As loader 200 is a work vehicle, frame 210 also supports a traction system 240, which is also powered by power system 220 and can propel the power machine over a support surface. The lift arm assembly 230 in turn supports an implement interface 270, which includes an implement carrier 272 that can receive and secure various implements to the loader 200 for performing various work tasks and power couplers 274, to which an implement can be coupled for selectively providing power to an implement that might be connected to the loader. Power couplers 274 can provide sources of hydraulic or electric power or both. The loader 200 includes a cab 250 that defines an operator station 255 from which an operator can manipulate various control devices 260 to cause the power machine to perform various work functions. Cab 250 can be pivoted back about an axis that extends through mounts 254 to provide access to power system components as needed for maintenance and repair.

The operator station 255 includes an operator seat 258 and a plurality of operation input devices, including control levers 260 that an operator can manipulate to control various machine functions. Operator input devices can include buttons, switches, levers, sliders, pedals and the like that can be stand-alone devices such as hand operated levers or foot pedals or incorporated into hand grips or display panels, including programmable input devices. Actuation of operator input devices can generate signals in the form of electric signals, hydraulic signals, and/or mechanical signals. Signals generated in response to operator input devices are provided to various components on the power machine for controlling various functions on the power machine. Among the functions that are controlled via operator input devices on power machine 200 include control of the tractive elements 219, the lift arm assembly 230, the implement carrier 272, and providing signals to any implement that may be operably coupled to the implement.

Loaders can include human-machine interfaces including display devices that are provided in the cab 250 to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided. Other power machines, such walk behind loaders may not have a cab nor an operator compartment, nor a seat. The operator position on such loaders is generally defined relative to a position where an operator is best suited to manipulate operator input devices.

Various power machines that can include and/or interacting with the embodiments discussed herein can have various different frame components that support various work elements. The elements of frame 210 discussed herein are provided for illustrative purposes and frame 210 is not the only type of frame that a power machine on which the embodiments can be practiced can employ. Frame 210 of loader 200 includes an undercarriage or lower portion 211 of the frame and a mainframe or upper portion 212 of the frame that is supported by the undercarriage. The mainframe 212 of loader 200, in some embodiments is attached to the undercarriage 211 such as with fasteners or by welding the undercarriage to the mainframe. Alternatively, the mainframe and undercarriage can be integrally formed. Mainframe 212 includes a pair of upright portions 214A and 214B located on either side and toward the rear of the mainframe that support lift arm assembly 230 and to which the lift arm assembly 230 is pivotally attached. The lift arm assembly 230 is illustratively pinned to each of the upright portions 214A and 214B. The combination of mounting features on the upright portions 214A and 214B and the lift arm assembly 230 and mounting hardware (including pins used to pin the lift arm assembly to the mainframe 212) are collectively referred to as joints 216A and 216B (one is located on each of the upright portions 214) for the purposes of this discussion. Joints 216A and 216B are aligned along an axis 218 so that the lift arm assembly is capable of pivoting, as discussed below, with respect to the frame 210 about axis 218. Other power machines may not include upright portions on either side of the frame or may not have a lift arm assembly that is mountable to upright portions on either side and toward the rear of the frame. For example, some power machines may have a single arm, mounted to a single side of the power machine or to a front or rear end of the power machine. Other machines can have a plurality of work elements, including a plurality of lift arms, each of which is mounted to the machine in its own configuration. Frame 210 also supports a pair of tractive elements in the form of wheels 219A-D on either side of the loader 200.

The lift arm assembly 230 shown in FIGS. 2-3 is one example of many different types of lift arm assemblies that can be attached to a power machine such as loader 200 or other power machines on which embodiments of the present discussion can be practiced. The lift arm assembly 230 is what is known as a vertical lift arm, meaning that the lift arm assembly 230 is moveable (i.e., the lift arm assembly can be raised and lowered) under control of the loader 200 with respect to the frame 210 along a lift path 237 that forms a generally vertical path along which the lift arm assembly can be raised or lowered. Other lift arm assemblies can have different geometries and can be coupled to the frame of a loader in various ways to provide lift paths that differ from the radial path of lift arm assembly 230. For example, some lift paths on other loaders provide a radial lift path. Other lift arm assemblies can have an extendable or telescoping portion. Other power machines can have a plurality of lift arm assemblies attached to their frames, with each lift arm assembly being independent of the other(s). Unless specifically stated otherwise, none of the inventive concepts set forth in this discussion are limited by the type or number of lift arm assemblies that are coupled to a particular power machine.

The lift arm assembly 230 has a pair of lift arms 234 that are disposed on opposing sides of the frame 210. A first end 232A of each of the lift arms 234 is pivotally coupled to the power machine at joints 216 and a second end 232B of each of the lift arms is positioned forward of the frame 210 when in a lowered position as shown in FIG. 2. Joints 216 are located toward a rear of the loader 200 so that the lift arms extend along the sides of the frame 210. The lift path 237 is defined by the path of travel of the second end 232B of the lift arms 234 as the lift arm assembly 230 is moved between a minimum and maximum height.

Each of the lift arms 234 has a first portion 234A of each lift arm 234 is pivotally coupled to the frame 210 at one of the joints 216 and the second portion 234B extends from its connection to the first portion 234A to the second end 232B of the lift arm assembly 230. The lift arms 234 are each coupled to a cross member 236 that is attached to the first portions 234A. Cross member 236 provides increased structural stability to the lift arm assembly 230. A pair of actuators 238, which on loader 200 are hydraulic cylinders configured to receive pressurized fluid from power system 220, are pivotally coupled to both the frame 210 and the lift arms 234 at pivotable joints 238A and 238B, respectively, on either side of the loader 200. The actuators 238 are sometimes referred to individually and collectively as lift cylinders. Actuation (i.e., extension and retraction) of the actuators 238 cause the lift arm assembly 230 to pivot about joints 216 and thereby be raised and lowered along a fixed path illustrated by arrow 237. Each of a pair of control links 217 are pivotally mounted to the frame 210 and one of the lift arms 232 on either side of the frame 210. The control links 217 help to define the fixed lift path of the lift arm assembly 230.

Some lift arms, most notably lift arms on excavators but also possible on loaders, may have portions that are controllable to pivot with respect to another segment instead of moving in concert (i.e., along a pre-determined path) as is the case in the lift arm assembly 230 shown in FIG. 2. Some power machines have lift arm assemblies with a single lift arm, such as is known in excavators or even some loaders and other power machines. Other power machines can have a plurality of lift arm assemblies, each being independent of the other(s).

An implement interface 270 is provided proximal to a second end 232B of the lift arm assembly 230. The implement interface 270 includes an implement carrier 272 that is capable of accepting and securing a variety of different implements to the lift arm 234. Such implements have a complementary machine interface that is configured to be engaged with the implement carrier 272. The implement carrier 272 is pivotally mounted at the second end 232B of the arm 234. Implement carrier actuators 235 are operably coupled the lift arm assembly 230 and the implement carrier 272 and are operable to rotate the implement carrier with respect to the lift arm assembly. Implement carrier actuators 235 are illustratively hydraulic cylinders and often known as tilt cylinders.

By having an implement carrier capable of being attached to a plurality of different implements, changing from one implement to another can be accomplished with relative case. For example, machines with implement carriers can provide an actuator between the implement carrier and the lift arm assembly, so that removing or attaching an implement does not involve removing or attaching an actuator from the implement or removing or attaching the implement from the lift arm assembly. The implement carrier 272 provides a mounting structure for easily attaching an implement to the lift arm (or other portion of a power machine) that a lift arm assembly without an implement carrier does not have.

Some power machines can have implements or implement like devices attached to it such as by being pinned to a lift arm with a tilt actuator also coupled directly to the implement or implement type structure. A common example of such an implement that is rotatably pinned to a lift arm is a bucket, with one or more tilt cylinders being attached to a bracket that is fixed directly onto the bucket such as by welding or with fasteners. Such a power machine does not have an implement carrier, but rather has a direct connection between a lift arm and an implement.

The implement interface 270 also includes power coupler(s) 274 available for connection to an implement on the lift arm assembly 230. The power coupler(s) 274 includes pressurized hydraulic fluid port to which an implement can be removably coupled. The pressurized hydraulic fluid port selectively provides pressurized hydraulic fluid for powering one or more functions or actuators on an implement. The power coupler can also include an electric power source for powering electric actuators and/or an electronic controller on an implement. The power coupler(s) 274 also exemplarily includes electric conduits that are in communication with a data bus on the excavator 200 to allow communication between a controller on an implement and electronic devices on the loader 200.

Frame 210 supports and generally encloses the power system 220 so that the various components of the power system 220 are not visible in FIGS. 2-3. The arrangement of drive pumps, motors, and axles in power machine 200 is but one example of an arrangement of these components. As discussed above, power machine 200 is a skid-steer loader and thus tractive elements on each side of the power machine are controlled together via the output of a single hydraulic pump, either through a single drive motor as in power machine 200 or with individual drive motors. Various other configurations and combinations of hydraulic drive pumps and motors can be employed as may be advantageous.

The description of power machine 100 and loader 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on a loader such as track loader 200, unless otherwise noted or recited, the concepts discussed below are not intended to be limited in their application to the environments specifically described above.

Figure 4:
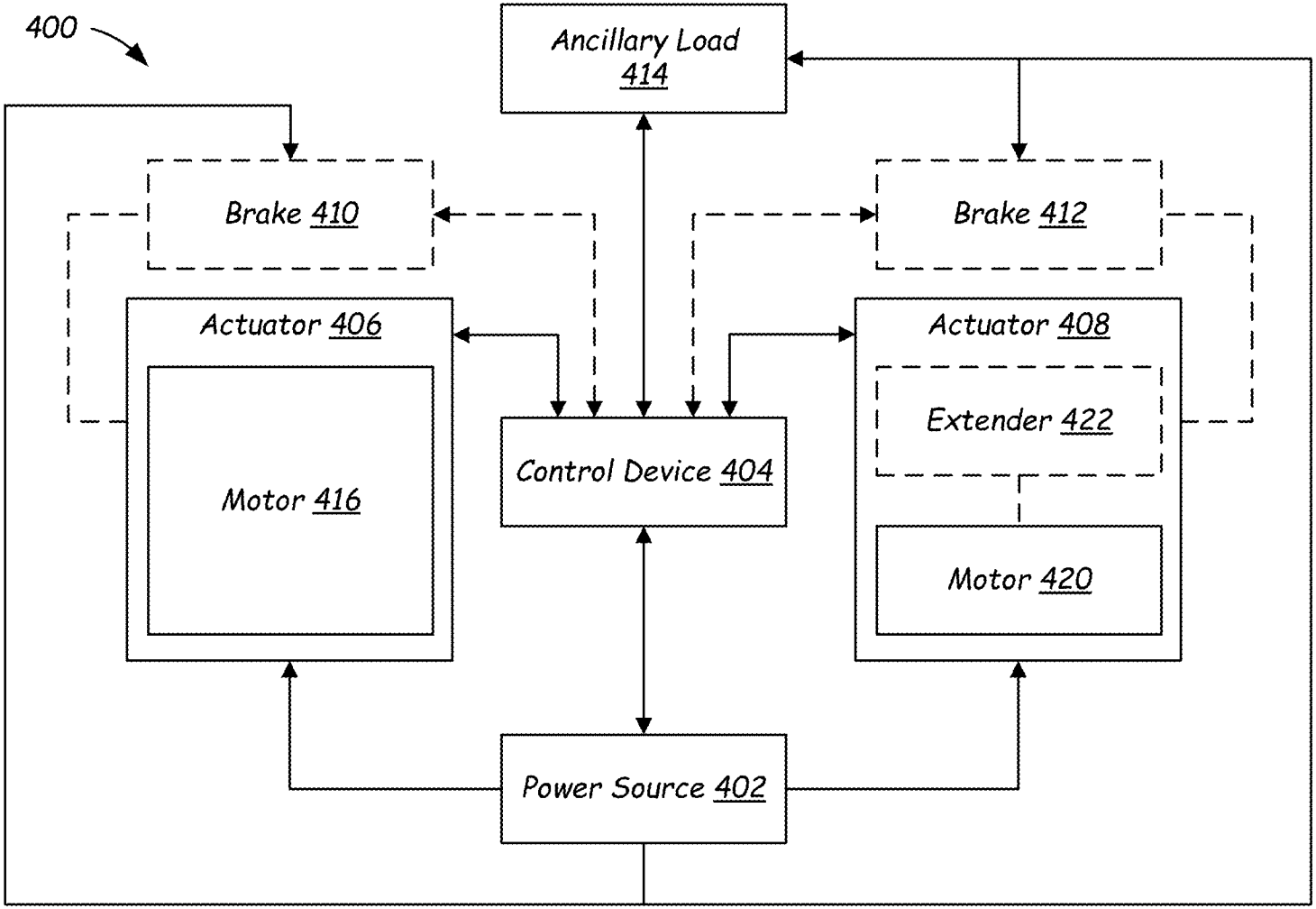
FIG. 4 is a block diagram illustrating components of a power system of the loader of FIGS. 2 and 3 or other power machines.

FIG. 4 shows a schematic illustration of a block diagram of a power machine 400, which can be any of a number of different types of power machines (e.g., wheeled or tracked skid-steer loaders), including any of the types generally discussed above. To accomplish various work and drive operations, the power machine 400 can include a power source 402, a control device 404, and electric actuators 406, 408. Either or both of the electric actuators 406, 408 can be variously configured as one or more drive actuators, or one or more workgroup actuators, and a different number of individual actuators can be provided than is generally shown in FIG. 4. For example, as further discussed below, some power machines can include a left-side and right-side drive actuators, each including a respective electronic drive motor disposed to power an associate tractive element (e.g., an endless track assembly), as well as various extendable (or other) work actuators (e.g., one or more extendable lift arm actuators, one or more extendable tilt actuators, etc.). In some cases, as also shown in FIG. 4, one or more brakes 410, 412 can be configured to stop movement of an associated one or more of the actuators 406, 408, including based on control signals from the control device 404.

In the illustrated example, the power machine 400 can be an electrically powered power machine and thus the power source 402 can include an electric power source such as, for example, a battery pack that includes one or more battery cells (e.g., lithium-ion batteries). In some embodiments, the power source 402 can include other electric storage devices (e.g., a capacitor), and other power sources. In addition, the power machine 400 can, but need not, include an internal combustion engine that provides, via a generator, electric power to the power source 402 (e.g., to charge one or more batteries of the electric power source).

Generally, the control device 404 can be implemented in a variety of different ways and can include one or more types or instances of known electronic controllers. For example, the control device 404 can be implemented as known types of processor devices, (e.g., microcontrollers, field-programmable gate arrays, programmable logic controllers, logic gates, etc.), including as part of one or more general or special purpose computers. In addition, the control device 404 can also include or be in operative communication with other computing components, including memory, inputs, output devices, etc. (not shown). In this regard, the control device 404 can be configured to implement some or all of the operations of the processes described herein, which can, as appropriate, be retrieved from or otherwise interact with memory. In some embodiments, the control device 404 can include multiple control devices (or modules) that can be integrated into a single component or arranged as multiple separate components. In some embodiments, the control device 404 can be part of a larger control system (e.g., the control system 160 of FIG. 1) and can accordingly include or be in electronic communication with a variety of control modules, including hub controllers, engine controllers, drive controllers, and so on.

In different embodiments, different types of actuators can be configured to operate under power from the power source 402, including electric actuators configured as rotary actuators, linear actuators, and combinations thereof. In the example shown in FIG. 4, the actuator 406 is a drive actuator and includes an electric motor 416 that is configured to provide rotational power to one or more tractive elements (not shown in FIG. 4). As noted above, some power machines can include multiple drive actuators, including as can be arranged for skid-steer operation.

Also as shown in the example of FIG. 4, the actuator 408 is a workgroup actuator and thus includes an electric motor 420 that is configured to provide rotational power for operation of one or more non-drive work elements (e.g., a lift arm, an implement, etc.). In some cases, the motor 420 can be configured to power movement of an extender 422 (e.g., a lead screw, a ball screw, another similar threaded assembly, or other known components for rotationally powered non-rotational movement), which can convert rotational power of the motor 420 into translational movement of the extender 422 so as to provide translational power to a work element of the power machine 400. For example, the motor 420 can rotate in a first direction to drive extension of the extender 422 and can rotate in a second direction to drive retraction of the extender 422 when the motor rotates in a second rotational direction opposite the first rotational direction. In this way, and depending on how the electric actuator 406 is coupled to the components of the power machine 400, extension (and retraction) of the electric actuator 406 can, for example, raise (or lower) a lift arm of the power machine 400, change an attitude an implement of the power machine 400 (e.g., a bucket), etc.

Thus, generally, each motor 416, 420 can be controlled to implement particular functionality for the power machine 400. As generally noted above, different configurations of multiple drive or workgroup actuators can be included in some cases (e.g., multiple instances of the actuators 406, 408 as shown), to provide different functionality for a particular power machine. For example, in some configurations, the power machine 400 can include an electric actuator that is a first lift actuator on a first lateral side of the power machine 400, an electric actuator that is a second lift actuator on a second lateral side of the power machine 400, an electric actuator that is a first tilt actuator that is on a first lateral side of the implement interface of the power machine 400, an electric actuator that is a second tilt actuator that is on a second lateral side of the implement interface of the power machine 400, an electric actuator that is a first drive actuator for a first drive system that is on (or otherwise powers one or more tractive elements for) the first lateral side of the power machine 400, and an electric actuator that is a second drive actuator for a second drive system that is on (or otherwise powers one or more tractive elements for) the second lateral side of the power machine 400.

As also noted above, the brakes 410, 412 can be coupled to (e.g., included in) the respective electric actuators 406, 408 in some embodiments. In this regard, a wide variety of known brake systems can be used. For example, one or more brakes can be a mechanical brake that includes a mechanical stop that can be moved into engagement to block movement of a relevant extender or relevant motor, in one or more directions, and can be moved out of engagement to allow movement of the relevant extender or motor. In some cases, a mechanical brake can include an arm that contacts a lead screw of an extender to block further movement of the lead screw. In some embodiments, one or more electrically powered brakes can be provided (i.e., brake assemblies that include one or more electric actuators for application of braking force).

As shown in FIG. 4, the power source 402 can be electrically connected to the control device 404, the electric actuators 406, 408, and the brakes 410, 412 (as appropriate), as well as one or more ancillary loads 414. Thus, the power source 402 can provide power to each motor 416, 420 to drive movement (e.g., extension and retraction) of the respective extenders 418, 422, to the control device 404, to each brake 410, 412 (as appropriate), to each of the ancillary load(s) 414, etc. Further, the power source 402 can provide power to the ancillary loads 414 (i.e., loads not associated with providing tractive or workgroup power) for various ancillary functionality. For example, ancillary loads 414 can include a climate control system (e.g., including a heater, an air-conditioning system, a fan, etc.), a sound system (e.g., a speaker, a radio, etc.), etc. In some cases, ancillary loads 414 may be treated with lower priority according to certain power management modes.

As shown in FIG. 4, the control device 404 can be in electrical communication with the power source 402, the actuators 406, 408, the brakes 410, 412 (as appropriate), and the ancillary load(s) 414, and can adjust (e.g., limit) the power delivered from the power source 402 to, or the power consumed by, each of these electric loads (or others). For example, as appropriate, the control device 404 can adjust (e.g., decrease) the power delivered to each of these electric loads by adjusting (e.g., decreasing) the electric current that can be consumed by at least some of these electric loads. In some cases, the control device 404 can adjust the electric current delivered to an electric load by adjusting a driving signal delivered to an electric current source (e.g., a voltage controlled electric current source) that can be electrically connected to the electric load (e.g., integrated within a power electronics driver board, such as a motor driver) to deliver electric current to the electric load. For example, the electric current source can include one or more field-effect transistors, and the driving signal can be the voltage applied to the one or more field-effect transistors to adjust the electric current delivered and thus the power delivered to the electric load (e.g., the motor).

In some embodiments, similarly to each of the electric loads of the power machine 400, the electric power source of the power source 402 can include (or can be otherwise electrically connected to) an electric current source (e.g., a power electronics board) that adjusts (e.g., and can restrict) the amount of power to be delivered to the electric loads of the power machine 400. In this case, the control device 404 can adjust the driving signal to the electric power source to adjust the total amount of electric current and thus the amount of power delivered to the electric loads of the power machine 400. For example, the control device 404 can adjust the output from the electric power source 402 to regulate the torque, position, direction, and speed of one or more motors powered by the power source 402.

In some embodiments, the control device 404 can be configured to determine a present (i.e., temporally current) power usage of one or more actuators or other electric loads, or a present power delivery from a power source. In some cases, a present power usage or delivery can be measured instantaneously. In some cases, a present power usage or delivery can be measured as an average power delivery over a recent time interval (e.g., a preceding 2 seconds). Thus, for example, the control device 404 can determine a present power usage for each electric load of the power machine 400, or can determine a present power delivery from the electric power source of the power source 402.

In some cases, each electric load of the power machine 400, and the power source 402 can include or can otherwise be electrically connected to an electric current sensor to determine the electric current being provided to (or by) the particular electric component, and a voltage being provided to (or by) the particular electric component can also be determined (e.g., based on voltage sensor or a fixed voltage provided by the power source 402). In this way, for example, the control device 404 can receive information about a present voltage and a present electric current that is delivered to each individual electric load, or about the present voltage and electric current that is supplied by the electric power source of the power machine 400 in total and can thereby determine a present power usage for relevant (e.g., all) electric loads and for the electric power source of the power machine 400.

In some embodiments, the control device 404 can determine a present power usage for the electric power source of the power machine 400 by adding the present power usage for each relevant electric load of the power machine 400 (e.g., as determined by multiplying electric current and voltage for the loads). Alternatively, for example, power can be determined by multiplying the torque and speed of one or more relevant motors. In certain circumstances, it may be advantageous to use either of these known methods. In other cases, the control device 404 can determine a present power usage of the electric power source of the power machine 400 only by determining the power delivered by the electric power source. For example, the control device 404 can receive a present value for electric current delivered by the electric power source 402 and, based on the voltage of the electric power source 402, can then determine a total present power usage for the electric power source. In some cases, the control device 404 can assume a substantially constant voltage for the electric power source and can then determine the present power usage of the electric power source by using the constant voltage and the present electric current value.

In some embodiments, the electric power source 402 can include or can be electrically connected to a sensor to sense a present remaining energy of the electric power source. In some cases, for example, a voltage sensor can sense the voltage of the electric power source, which can be indicative of the present remaining energy left within the electric power source (e.g., because the voltage of the electric power source can be related to the present remaining energy within the electric power source). Any suitable means for sensing the remaining energy of the electric power source can be used, including an accounting of how much electric current is supplied by the energy storage device over time.

Figure 5:
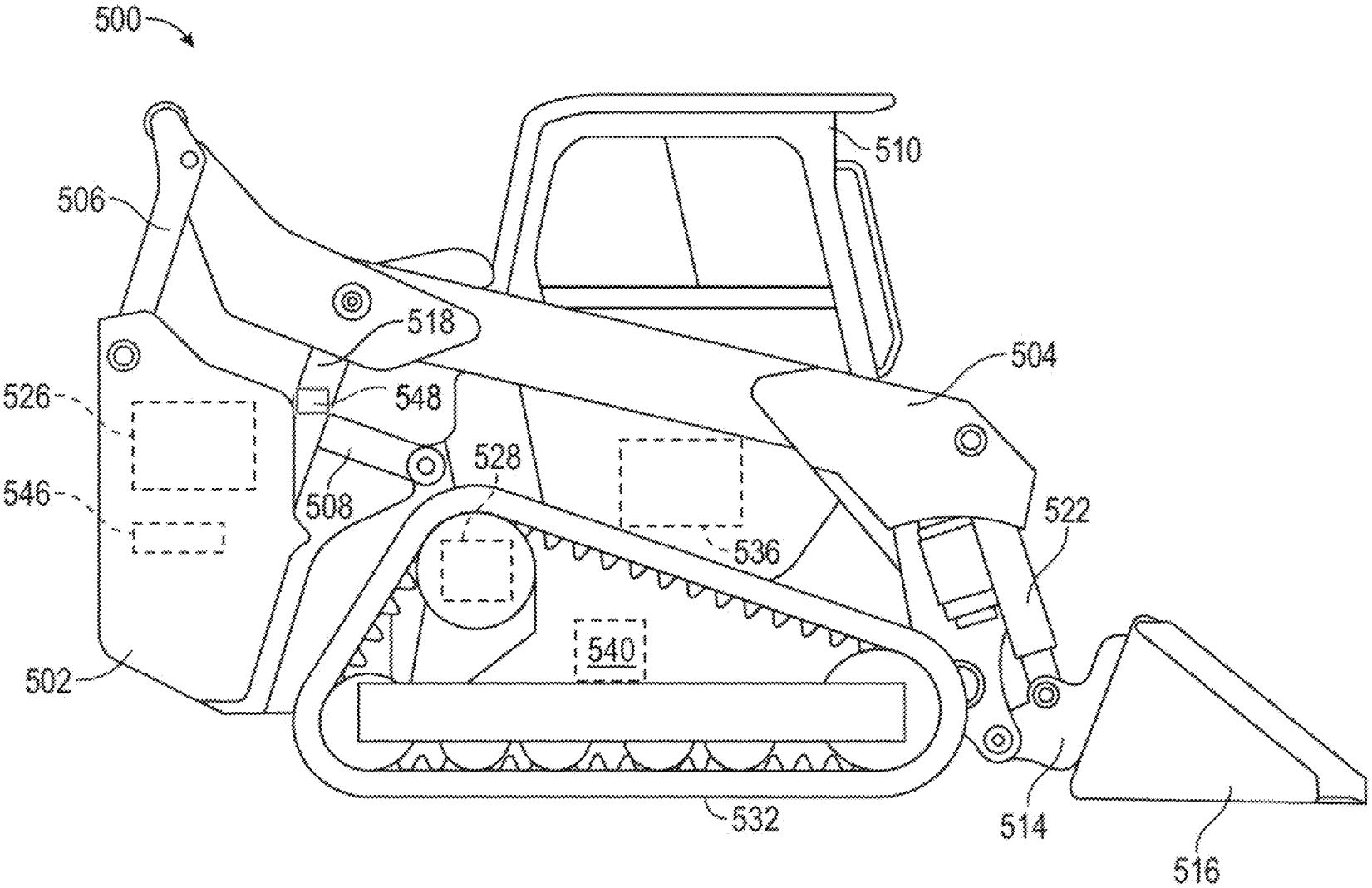
FIG. 5 is a side elevation view showing certain components of a power machine in the form of an electrically powered compact tracked loader according to configurations of the disclosure.

In some embodiments, the power machine 400 can include one or more sensors that can sense various aspects of the power machine 400. For example, the power machine 400 can include a torque sensor for one or more electric actuators, to sense a present torque of the one or more electric actuator. In some cases, the torque sensor can be the same as the electric current sensor electrically connected to the electric actuator (e.g., because electric current is related to the torque). As another example, the power machine 400 can include a position sensor for one or more extenders or other components of one or more electric actuators (as appropriate), including as may sense a present extension amount for an extender of an electric actuator (e.g., relative to the housing of the electric actuator). In some cases, this can be a hall-effect sensor, a rotary encoder for the motor (e.g., which can be used to determine the extension amount of actuators with extenders), an optical sensor, etc. In some cases, as shown in FIG. 5, the power machine 400 can include a resolver 548 configured to track relative movement of the actuator 518. As yet another example, the power machine 400 can include an angle sensor for one or more pivotable joints (e.g., of the lift arm) to determine a present orientation of the lift arm (and any implement coupled thereto). As yet another example, the power machine 400 can include a speed sensor or an acceleration sensor (e.g., an accelerometer) to respectively determine a present speed or a present acceleration of the entire power machine 400 or of a component thereof. As still yet another example, the power machine 400 can include an inclinometer (e.g., an accelerometer) that can sense the present attitude of a mainframe of the power machine 400 with respect to gravity.

FIG. 5 shows a side isometric view of an electrically powered power machine 500 with a lift arm in a fully lowered position, which can be a specific implementation of the power machine 200, the power machine 400, etc. As shown in FIG. 5, the power machine 500 can include a main frame 502, a lift arm 504 coupled to the main frame via a follower link 506, a driver link 508 pivotally coupled to the lift arm 504 and the main frame 502, an operator enclosure 510 (e.g., a cab, as shown), an implement interface 514 coupled to an end of the lift arm 504, an implement 516 (e.g., a bucket as shown) coupled to the implement interface 514, an electric lift actuator 518, an electric tilt actuators 522, an electric power source 526, a drive system 528 (e.g., including an electric drive motor), a traction devices 532 (e.g., an endless track, as shown), and a climate control system 536 (e.g., as generally representative of an ancillary electric load). In some embodiments, a suspension system 540 (e.g., a torsional suspension system) can be included, to provide improved ride control and overall smoothness of travel. As generally noted above, similar (e.g., substantially identical) other components can be provided symmetrically (or otherwise) on an opposing lateral side of the power machine 500 in some cases, including another electric lift actuator, another electric tilt actuator, etc.

In some cases, the electric power source 526 can be implemented in a similar manner as the previously described power sources (e.g., the power source 402). Thus, the electric power source 526 can include a battery pack including one or more batteries. In general, the electric power source 526 can supply power to some or all of the electric loads of the power machine 500. For example, the electric power source 526 can provide power to the lift electric actuator 518, the electric tilt actuator 522, the drive system 528, the climate control system 536, etc.

The power machine 500 can also include a control device 546 (e.g., a general or special purpose electronic computer or other electronic controller) that can be in communication with the power source 526 and some (or all) of the electric loads of the power machine 500, as appropriate. For example, the control device 546 can be in communication with the lift electric actuator 518, the electric tilt actuator 522, the drive system 528, the climate control system 536, etc. In this way, the control device 546 can control operation of these components, or related other systems, to adjust how power is routed to each of these electric loads (e.g., depending on the criteria defined by a particular power management mode) and, correspondingly, how these components operate under power from the power source 526.

Figure 6:
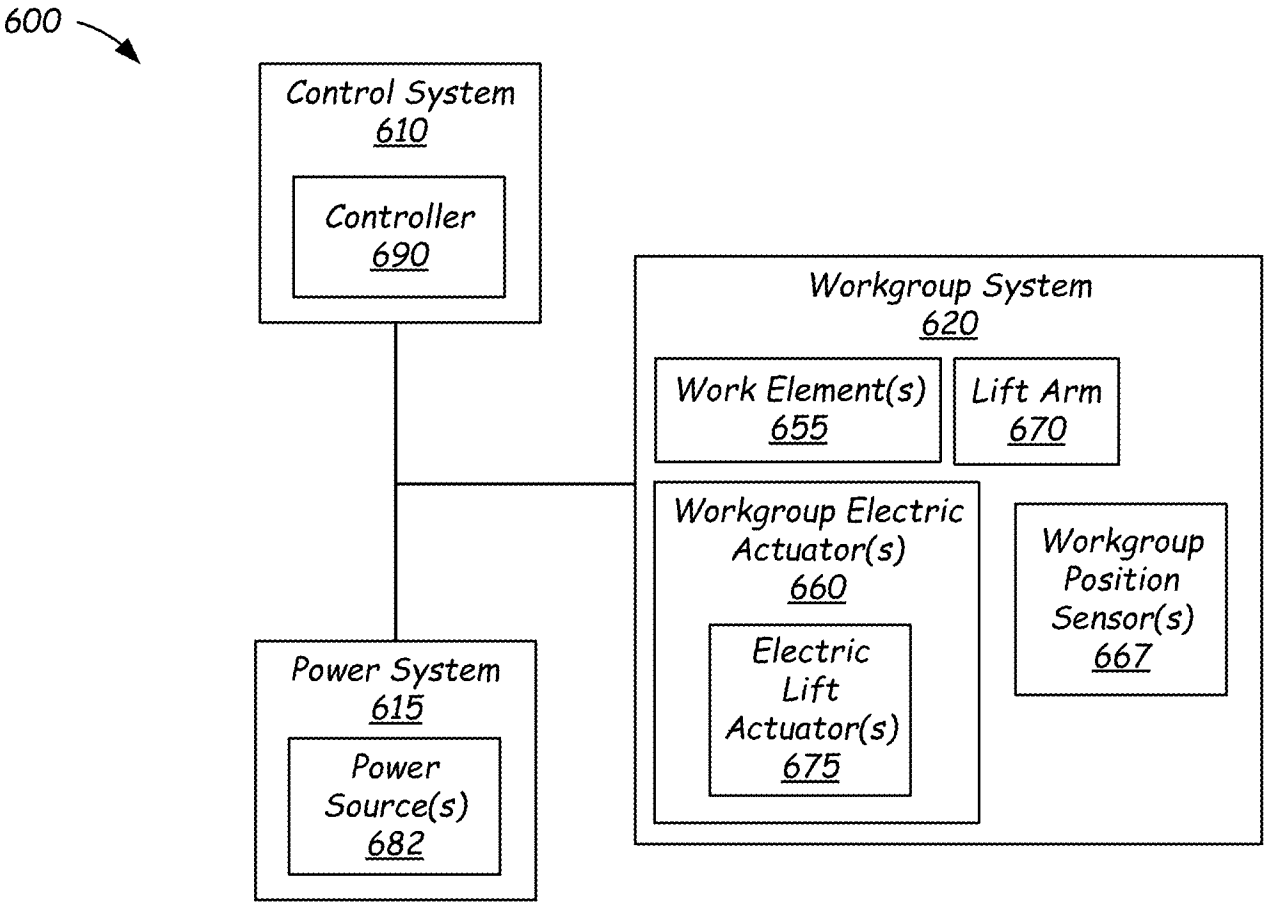
FIG. 6 is a block diagram of a power machine according to some configurations.

FIG. 6 schematically illustrates a power machine 600 according to some configurations. In the example illustrated in FIG. 6, the power machine 600 includes a control system 610 (e.g., the control system 160, as described herein), a power system 615, and a workgroup system 620. The control system 610, the power system 615, and the workgroup system 620 communicate over one or more communication lines or buses. The power machine 600 may include additional, fewer, or different components than those illustrated in FIG. 6 in various configurations and may perform additional functionality than the functionality described herein. For example, the power machine 600 may include additional, similar, or different components, systems, and functionality as described above with respect to the power machine 100 of FIG. 1, the loader 200 of FIGS. 2-3, the power machine 400 of FIG. 4, the electric power machine 500 of FIG. 5, or another power machine described herein.

As illustrated in FIG. 6, the power machine 600 includes the workgroup system 620, which can in some cases be a lift arm structure (as further discussed in examples herein). In the illustrated example, the workgroup system 620 may include one or more work elements 655 (e.g., the work element 130 of FIG. 1, the bucket 516 of FIG. 5, or another attached implement), one or more workgroup electric actuators 660, one or more workgroup position sensors 667, and a lift arm 670 (e.g., the lift arm assembly 230 or a component thereof, as described herein).

In the illustrated example, the workgroup electric actuators 660 of the workgroup system 620 includes one or more electric lift actuators 675. Generally, lift actuators corresponding to the electric lift actuator(s) 675 are described in greater detail herein with respect to FIGS. 1-5. The workgroup position sensors 667 can be configured to measure a linear extension or angular orientation of an actuator or other component of a workgroup. For example, the workgroup position sensors 667 can be configured to measure lift arm position (e.g., height, extension, etc.). In some examples, one or more of the workgroup position sensors 667 can be integrated into one or more of the workgroup electric actuators 660 (e.g., can be included as part of the electric lift actuator(s) 675).

The workgroup position sensor(s) 667 may collect position data for the power machine 600 (or a component thereof). As one example, the workgroup position sensor 667 may be associated with one of the workgroup electric actuators 660, and may detect position data for the associated workgroup electric actuator 660. For example, the workgroup position sensors 667 may measure or otherwise indicate rotational position data for an electric servo motor. As another example, the workgroup position sensors 667 may be associated with extenders of the workgroup electric actuators 660 (e.g., ball screws or other motor-driven extenders). Accordingly, in some configurations, the workgroup position sensors 667 may sense a present extension amount (as position data) for the extender of each workgroup electric actuator 660 (e.g., an extension distance relative to a housing of the workgroup electric actuator 660). In some cases, the workgroup position sensor 667 may be a hall-effect sensor, a rotary encoder for the motor (e.g., which can be used to determine the extension amount of actuators with extenders), an optical sensor, etc. Accordingly, in some configurations, position data may include a lift height of the lift arm 670 or the work element 655, an extension amount associated with the electric lift actuator 675, or the like.

The power machine 600 may also include the power system 615 (e.g., the power system 120 of FIG. 1, the power system 220 of FIG. 2, etc.). In the illustrated example of FIG. 6, the power system 615 may include one or more power sources 682. As described herein, the power system 615 (via one or more of the power sources 682) may generate or otherwise provide electric power for operating various functions on the power machine 600 (or components thereof). The power system 615 may provide electric power to various components of the power machine 600, such as, e.g., one or more components of the control system 610, the workgroup system 620, or the like. Accordingly, the power machine 600 can be an electrically powered power machine and, thus, the power source(s) 682 of the power system 615 can include electric power sources, such as, e.g., a battery pack that includes one or more battery cells (e.g., lithium-ion batteries). In some configurations, the power system 615 can include other electric storage devices (e.g., a capacitor), and other power sources. Alternatively, or in addition, the power machine 600 can, but need not, include an internal combustion engine that provides, via a generator, electrically power to the power sources 682 (e.g., to charge one or more batteries of the electric power system 615).

The power machine 600 may also include the control system 610. The control system 610 (e.g., the control system 160 of FIG. 1) is configured to receive operator input or other input signals (e.g., sensor data, such as speed data, position data, tilt or orientation data, or a combination thereof) and to output commands accordingly to control operation of the power machine 600. For example, the control system 610 can communicate with other systems of the power machine 600 to perform various work tasks, including to control the workgroup electric actuator(s) 660 for performing a work task operation (e.g., a digging operation, a roading operation, etc.), another operation of the power machine 600, or a combination thereof.

In some configurations, the control system 610 receives input from an operator input device, such as one of the operator input devices 262 of FIG. 2, including input as command signals provided by an operator of the power machine 405 via the operator input device 262 (also referred to herein as operator commands). As one example, an operator command or command signal may include a commanded lift for the workgroup system 620 of the power machine 600 (e.g., a change in lift of the work element at which the operator of the power machine 600 requests or commands). In response to receiving the input, the control system 610 may control the power machine 600 to perform the requested operation or otherwise maneuver based at least in part on the input received from the operator input device, the sensed operation data, or a combination thereof. Accordingly, in some configurations, the control system 610 may receive an input parameter corresponding to an operator command or input associated with operating the power machine 600, sensed operation data associated with the power machine 600, or a combination thereof.

Figure 7:
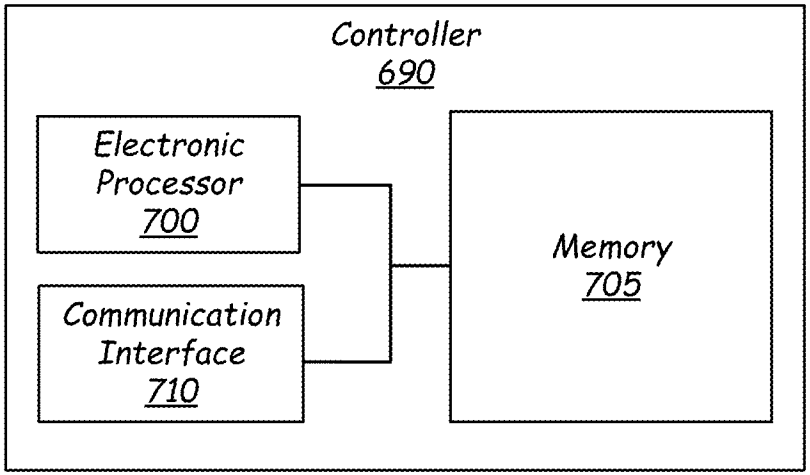
FIG. 7 schematically illustrates a controller of the power machine of FIG. 6 according to some configurations.

As illustrated in FIG. 6, the control system 610 includes a controller 690 (e.g., the control device(s) 260, 404 as described herein). FIG. 7 illustrates the controller 690 according to some configurations. In the illustrated example of FIG. 7, the controller 690 includes an electronic processor 700 (for example, a microprocessor, an application-specific integrated circuit ("ASIC"), or another suitable electronic device), a memory 705 (for example, a non-transitory, computer-readable medium), and a communication interface 710. The electronic processor 700, the memory 705, and the communication interface 710 communicate over one or more communication lines or buses. The controller 690 may include additional components than those illustrated in FIG. 7 in various configurations and may perform additional functionality than the functionality described herein. As one example, in some embodiments, the functionality described herein as being performed by the controller 690 may be distributed among other components or devices (e.g., one or more electronic processors).

The communication interface 710 allows the controller 690 to communicate with devices external to the controller 690. For example, as illustrated in FIG. 6, the controller 690 may communicate with the workgroup system 620 (or component(s) therein), other components or systems of the power machine 600, or a combination thereof through the communication interface 710.

The communication interface 710 may include a port for receiving a wired connection to an external device (for example, a universal serial bus ("USB") cabled and the like), a transceiver for establishing a wireless connection to an external device (for example, over one or more communication networks, such as the Internet, local area network ("LAN"), a wide area network ("WAN"), and the like), or a combination thereof. In some configurations, the controller 690 can be a dedicated or stand-alone controller. In some configurations, the controller 690 can be part of a system of multiple distinct controllers (e.g., a hub controller, a drive controller, a workgroup controller, etc.) or can be formed by a system of multiple distinct controllers (e.g., also with hub, drive, and workgroup controllers, etc.), where the multiple distinct controllers communicate via a controller area network ("CAN") bus.

The electronic processor 700 is configured to access and execute computer-readable instructions ("software") stored in the memory 705. The software may include firmware, one or more applications, program data, filters, rules, one or more program modules, and other executable instructions. For example, the software may include instructions and associated data for performing a set of functions, including the methods described herein.

Figure 8:
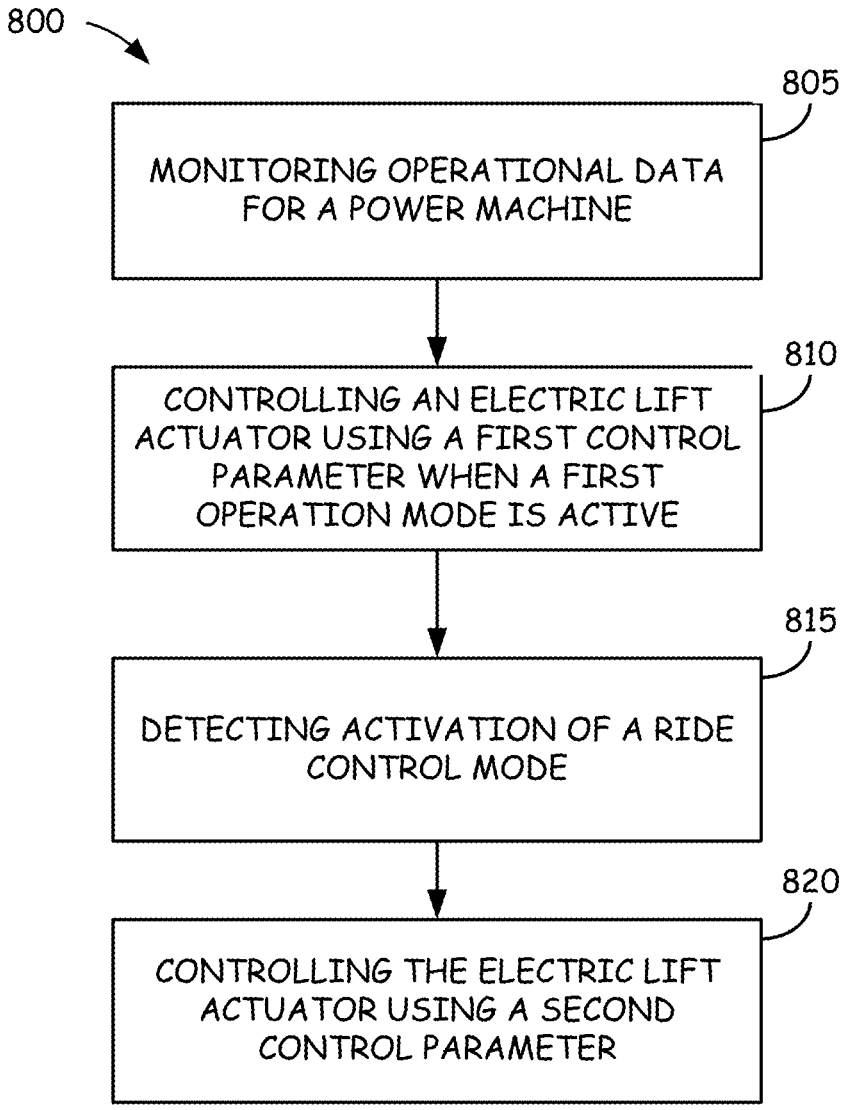
FIG. 8 is a flowchart for controlling a power machine according to some configurations.

FIG. 8 is a flowchart illustrating a method 800 for controlling a power machine (e.g., the power machine 600) according to some configurations. In some configurations, the method 800 can be performed by the control system 610 (e.g., the controller 690) and, in particular, by the electronic processor 700 of the controller 690. However, as noted above, the functionality described with respect to the method 800 may be performed by other devices or can be distributed among a plurality of devices or components (e.g., one or more electronic processors).

As illustrated in FIG. 8, the method 800 may include monitoring (or receiving) operational data for the power machine 600 (at block 805). Operational data may include input received from the operator input device (e.g., operator commands), sensed operation data, or a combination thereof. An operator command may include input received via the operator input device(s) from an operator of the power machine 600. Sensed operation data may include information or data collected by one or more sensors of the power machine 600, such as, e.g., the workgroup positions sensor(s) 667. Accordingly, in some configurations, the operational data may include position related data collected by the workgroup position sensor(s) 667, such as, e.g., an extension amount, a linear extension or angular orientation of an actuator or other component of a workgroup, a degree of tilt between the work element 655 and the lift arm 670, a lift height of the lift arm 670 or the work element 655, etc. Accordingly, in some configurations, the electronic processor 700 may receive the operational data for the power machine 600 from an operator input device, the workgroup position sensor(s) 667, another component or device of the power machine 600, etc.

Alternatively, or in addition, in some configurations, the electronic processor 700 may receive the operational data from the workgroup electric actuator(s) 660. For instance, the workgroup electric actuator(s) 660 may provide position related data (as operational data) to the electronic processor 700. In some cases, the workgroup electric actuator(s) 660 may provide information with respect to a present (or temporally current) extension amount to the electronic processor 700 and then, as further detailed below, the electronic processor 700 may determine a present lift position for a lift assembly based on the present extension amount.

In some configurations, the operational data my include data associated with one or more control parameters. A control parameter may be a parameter or value that may affect control of the power machine 600 (or a component thereof). For instance, a control parameter may be implemented as a command issued to a component of the power machine 600 such that, upon receipt of that command, operation of the component of the power machine 600 is controlled using the command. A control parameter may include, e.g., a velocity control parameter, an electric current control parameter, a position control parameter, etc. A velocity control parameter may include, e.g., a velocity parameter or value that may be used to control a velocity of a component of the power machine 600 (e.g., such as a target velocity). An electric current control parameter may include, e.g., an electric current parameter of value that may be used to control an electric current of a component of the power machine 600 (e.g., such as a target electric current). A position control parameter may include, e.g., a position parameter or value that may be used to control position of a component of the power machine 600 (e.g., such as a target position).

In some configurations, the power machine 600 may be configured to operate in a plurality of different operating modes, such that, when operating in a specific operating mode, one or more specific functions or features are enabled. As one example, the power machine 600 may operate in a ride control mode. When operating in the ride control mode, the power machine 600 may operate in a damping capacity, such that the lift arm assembly (e.g., the work element 655, a load held by the work element 655, the lift arm 670, etc.) of the power machine 600 may move independently of the chassis of the power machine 600 as external forces from the terrain traversed by the power machine 600 are applied to the lift arm assembly. Accordingly, in some examples, a ride control mode may be implemented to return to (or maintain) a target lift position for a lift assembly, including, e.g., a work element supported by the lift assembly, as the power machine traverses terrain. For example, an actual (or present) lift position for the lift assembly may deviate from that target lift position in response to the external forces from traversing the terrain and, using position related information, the target lift position may be returned to based on a deviation from the target lift position caused by external forces on the power machine 600 (e.g., the lift assembly or a component thereof).

An operating mode may be associated with or executed using a control scheme, including one or more control parameters. A control scheme may include, e.g., an electric current control scheme, a velocity control scheme, a position control scheme, etc. For instance, when operating pursuant to an electric current control scheme, electric current may be used to control operation of the power machine 600, with control being affected based on a target electric current (i.e., force) and a deviation from that target electric current (e.g., an electric current control parameter). When operating in a velocity control scheme, velocity may be used to control operation of the power machine 600, with control being affected based on a target velocity and a deviation from that target velocity (e.g., a velocity control parameter). When operating in a position control scheme, position may be used to control operation of the power machine 600, with control being affected based on a target position and deviation from that target position (e.g., a position control parameter).

In some implementations, a first control scheme (e.g., velocity or position control) can be useful during work operations, but a different control scheme (e.g., electric current control) can be useful to provide ride control. Thus, it may be useful to transition between different control schemes depending on the particular present operation. In this regard, generally, when operating in accordance with a first control scheme, the power machine 600 may be controlled using one or more control parameters specific to that first control scheme. Similarly, when operating in accordance with a second different control scheme, the power machine 600 may be controlled using one or more control parameters specific to that second control scheme.

Accordingly, when the power machine 600 is operating in a ride control mode (e.g., when ride control is enabled for the power machine 600), the power machine 600 may be controlled using a control scheme specific to the ride control mode. In some examples, the power machine 600 is controlled via an electric current control scheme (using one or more electric current control parameters) when ride control is enabled. In contrast, in some instances, when the power machine 600 is operating in another control mode (e.g., when ride control is disabled for the power machine 600), the power machine 600 may be controlled using a different control scheme, such as, e.g., a velocity control scheme. In such instances, the power machine 600 may be controlled via a velocity control scheme using one or more velocity control parameters.

Accordingly, in some configurations, the electronic processor 700 may receive one or more control parameters as part of the operational data (e.g., the operational data monitored or received at block 805). For example, the operational data may include data related to an electric current control scheme (e.g., an electric current control parameter), a velocity control scheme (e.g., a velocity control parameter), a position control scheme (e.g., a position control parameter), etc. As noted herein, a control parameter may be a parameter or value that may affect control of the power machine 600 (or a component thereof). For example, a control parameter may be based on an operator input or command (e.g., based on an operator's interaction with an operator input device of the power machine 600). For instance, the control parameters may be operator commands for controlling the power machine 600 (or component(s) thereof). In some examples, the control parameters may include data associated with a present operation of the power machine 600 (or component(s) thereof). For example, the control parameters may include a present electric current draw (e.g., as an electric current control parameter), a present velocity (e.g., as a velocity control parameter), or a present position (e.g., as a position control parameter) for the workgroup electric actuator(s) 660 (e.g., the electric lift actuator(s) 675).

The electronic processor 700 may control the power machine 600 using a control parameter (e.g., a first control parameter) when a corresponding operation mode (e.g., a first operation mode) is active (at block 810). In some configurations, the electronic processor 700 may control the power machine 600 according to a first control scheme, where the operational data includes data related to a corresponding control parameter for the first control scheme. For example, when the power machine 600 is operating using a velocity control scheme, the electronic processor 700 may control the power machine 600 using a velocity control parameter. Thus, for example, when a lift arm is not being commanded to move by an operator (i.e., when zero velocity is commanded), the electronic processor 700 may control a lift actuator to prevent movement in response to external forces.

Continuing, the electronic processor 700 may detect activation of a ride control mode (at block 815). In some configurations, an operator of the power machine 600 may manually activate the ride control mode. For instance, in some configurations, the electronic processor 700 may receive a request to activate the ride control mode for the power machine 600 (also referred to herein as an "activation request"). The electronic processor 700 may receive the activation request from an operator input device of the power machine 600. As one example, an operator may activate the ride control mode via a switch (or other operator input device) included within an operator cab of the power machine 600 such that when the switch is "ON" the ride control mode is active and when the switch is "OFF" the ride control mode is inactive (e.g., has no effect on machine operation). Responsive to receiving the request to activate the ride control mode, the electronic processor 700 may activate the ride control mode for the power machine 600. Alternatively, or in addition, in some configurations, the electronic processor 700 may determine an availability of the ride control mode based on, e.g., one or more operating conditions of the power machine 600 (prior to activating ride control mode). For example, the ride control mode may be available when the power machine 600 is performing a tractive operation (e.g., traveling within a particular speed range), when the lift arm 670 is stationary, etc.

Alternatively, or in addition, activation of the ride control mode may be automated based on, e.g., operational conditions or operations (e.g., automatically activated based on a determined work task, work cycle, etc.). The electronic processor 700 may automatically activate the ride control mode using one or more activation conditions (or triggers). An activation condition may include one or more operating conditions or operations that, when detected, trigger activation of the ride control mode (e.g., conditions as further detailed below). Accordingly, in some configurations, the electronic processor 700 may analyze the operational data to detect an activation condition for triggering automated activation of the ride control mode.

Although not illustrated in FIG. 7, the memory 705 may store one or more activation conditions for the ride control mode. Alternatively, or in addition, in some configurations, the activation condition(s) may be stored remotely, such as, for example, in a memory of a user device, or another remote device or database, such that the activation condition(s) are accessible by the controller 690.

As one example, the activation condition may be a present speed or rate of travel for the power machine 600. Following this example, the electronic processor 700 may determine whether a present speed of the power machine 600 satisfies a speed threshold. The speed threshold may be a preset speed value at which ride control is recommended or desirable. For example, the speed threshold may be satisfied when the present speed of the power machine 600 is greater than or equal to 1 mph. When the present speed of the power machine 600 satisfies the speed threshold, the electronic processor 700 may detect the activation condition and activate ride control mode for the power machine 600.

As another example, the activation condition may be a present lift position of the lift assembly. Following this example, the electronic processor 700 may determine a present lift position of the lift assembly based on the operational data (e.g., position related data received from the electric lift actuator 675, the workgroup position sensor(s) 667, etc.). The electronic processor 700 may determine whether the present lift position of the lift assembly satisfies a position threshold. The position threshold may be a preset position value at which ride control is recommended or desirable. For example, the position threshold may be satisfied when the present lift position is greater than or equal to 5 inches (above fully lowered/retracted). When the present lift position of the power machine 600 satisfies the position threshold, the electronic processor 700 may detect the activation condition and activate ride control mode for the power machine 600.

As another example, the activation condition may relate to whether the lift assembly is stationary or non-stationary (e.g., actively moving responsive to operator commands). Following this example, the electronic processor 700 may determine whether a present lift position for the lift assembly is dynamically changing based on, e.g., the operational data, sensed data, operator input, etc. (e.g., determine whether the lift assembly is stationary). When the electronic processor 700 determines that the lift assembly is stationary, the electronic processor 700 may detect the activation condition and activate ride control mode for the power machine 600.

In some examples, the activation condition may relate to a combination of two or more of a present lift position, a present lift assembly velocity (or commanded velocity), or a present travel speed. For example, the electronic processor 700 may detect an activation condition that prompts activation of ride control mode based on a combination of at least a threshold lift height, zero commanded velocity, and a particular velocity range for travel over terrain.

Responsive to activation of the ride control mode for the power machine 600, the electronic processor 700 may control the power machine 600 in accordance with a control scheme associated with the ride control mode. For example, at block 820, the electronic processor 700 may control the electric lift actuator 675 to return to (or maintain) a target lift position using a second control parameter while the power machine 600 performs a tractive operation (e.g., a roading operation), where the second control parameter is different from the first control parameter of the first operating mode (e.g., a non-ride control mode). In this regard, in some configurations, prior to activation of the ride control mode, the electronic processor 700 may control a velocity of the electric lift actuator 675 using, a velocity control parameter. In contrast, when ride control mode is activated, the electronic processor 700 may control an electric current of the electric lift actuator 675 using, e.g., an electric current control parameter, as described in greater detail herein.

Figure 9:
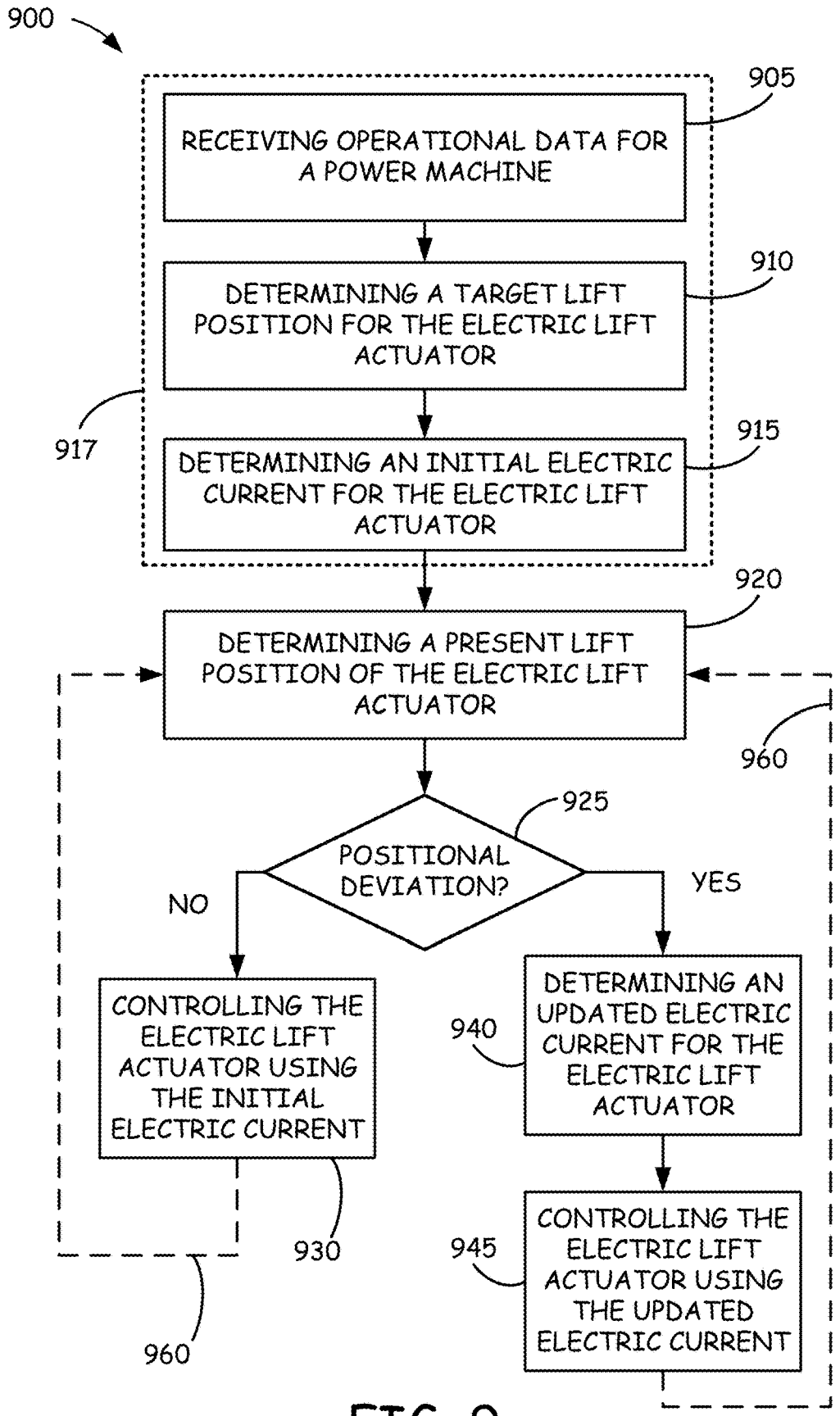
FIG. 9 is a flowchart for implementing ride control for a power machine according to some configurations.

FIG. 9 is a flowchart illustrating a method 900 for implementing ride control for a power machine (e.g., the power machine 600) according to some configurations. In some configurations, the method 900 can be performed by the control system 610 (e.g., the controller 690) and, in particular, by the electronic processor 700 of the controller 690. However, as noted above, the functionality described with respect to the method 900 may be performed by other devices or can be distributed among a plurality of devices or components (e.g., one or more electronic processors).

As illustrated in FIG. 9, the method 900 may include receiving operational data for the power machine 600 (at block 905). As described in greater detail herein, operational data may include input received from the operator input device (e.g., operator commands), sensed operation data, position related information (e.g., an extension amount), or a combination thereof. The electronic processor 700 may receive the operational data for the power machine 600 from an operator input device, the workgroup position sensor(s) 667, the workgroup electric actuator(s) 660, another component or device of the power machine 600, etc.

Continuing, based on the received operational data (at block 905), the electronic processor 700 may determine a present (or temporally current) lift position of a lift arm assembly (e.g., the lift arm 670, the electric lift actuator(s) 675, the lift arm assembly 230, etc.) (at block 910). As generally discussed above, a present lift position may refer to a present lift height, a present extension amount, or a present position of the electric lift actuator(s) 675 (e.g., how far the electric lift actuator(s) 675 is extended), or other value specifying the orientation of the lift arm assembly.

In some cases, the electronic processor 700 may derive the present lift position based on the operational data. For example, using known geometric details of the lift arm assembly 230 or the power machine 600 generally, the electronic processor 700 can calculate various positional information for the lift arm assembly 230 from operational data corresponding to a present extension amount of the electric lift actuator 675, a present lift position detected by the workgroup position sensor(s) 667, etc.

In some cases, the electronic processor 700 may determine that the operational data received at block 905 is a present lift position as can be used for further method operations. For example, rather than derive an angular or height value for a lift arm based on operational data that indicates a particular extension of a lift arm actuator, the electronic processor 700 may use the operational data directly, i.e., as the present lift position, for determination of, e.g., an updated electric current (e.g., an electric current control parameter), as further detailed below.

In some instances, the present lift position (at block 910) may represent or be a target lift position (e.g., a desired position of the load). For instance, in some configurations, the target lift position is determined as the present lift position of the electric lift actuator upon activation of the ride control mode. The target lift position may be a lift position for a load of the power machine that an operator of the power machine 600 wants to maintain as the power machine 600 performs a tractive operation over terrain. Accordingly, in some instances, the present lift position determined at block 910 may also be referred to herein as a "target lift position."

The electronic processor 700 may determine, based on the operational data (at block 905), an initial (or starting) electric current of the lift arm assembly (e.g., the lift arm 670, the electric lift actuator(s) 675, the lift arm assembly 230, etc.) (at block 915). The initial electric current may be a present electric current of the lift arm assembly. For example, the initial electric current may be a present electric current of the electric lift actuator 675 that maintains the target lift position (e.g., an amount of electric current that holds a load at the target lift position). For instance, in some configurations, the initial electric current is determined as the present electric current of the electric lift actuator 675 upon activation of the ride control mode, where the initial electric current (e.g., the present electric current) corresponds with the target lift position and zero movement of the lift arm (i.e., an electric current needed to hold a load stationary against gravity at a present height, absent additional external forces).

In some configurations, the electronic processor 700 may perform one or more of the steps of method 900 as part of initiating a ride control mode. For instance, the electronic processor 700 may perform one or more of blocks 905, 910, and 915 as part of an initiation stage for the ride control mode (as illustrated in FIG. 9 by dashed box 917). While FIG. 9 illustrates the initiation stage for the ride control mode as included blocks 905, 910, and 915, in some configurations, the initiation stage may include additional, fewer, or different steps in different configurations than illustrated in FIG. 9. For example, in some configurations, the initiation stage for the ride control mode may include block 910 and block 915.

As operation in a ride control mode continues, changes in external forces on a lift arm and may accordingly result in movement of a lift arm away from an initial (e.g., target) position. Accordingly, during ride control mode, the electronic processor 700 may determine, based on the operational data, a present lift position of the electric lift actuator 675 (at block 920). In some configurations, the electronic processor 700 may determine the present lift position as similarly described above with respect to the target lift position (e.g., block 910).

In some configurations, the electronic processor 700 determines the present lift position of the electric lift actuator 675 (at block 920) during performance of a tractive operation (e.g., while the power machine 600 traverses a terrain). As noted herein, when the power machine 600 traverses a terrain, the load of the power machine 600 may vary due to external forces from traversing the terrain. Accordingly, in some instances, the present lift position of the electric lift actuator 675 (at block 920) may be a present lift position of the electric lift actuator 675 resulting from the external forces experienced from traversing the terrain. For example, when the power machine 600 traverses a terrain, the load of the power machine 600 may experience a change (e.g., an increase or decrease) in lift position, where this change in lift position may be the present lift position determined in block 920.

After determining the present lift position (at block 920), the electronic processor 700 may determine whether the lift arm assembly experienced a positional deviation from the target lift position (at block 925). For instance, the electronic processor 700 may monitor the operational data to detect positional deviations from the target lift position. Accordingly, in some configurations, the electronic processor 700 may receive the operational data at block 905 repetitively (e.g., continuously, or intermittently). The electronic processor 700 may detect a positional deviation when the present lift position (determined at block 920) differs from the target lift position (determined at block 910). In some configurations, the electronic processor 700 may determine a difference between the present lift position (determined at block 920) and the target lift position (determined at block 910). The electronic processor 700 may then detect a positional deviation when the difference is a non-zero value. Alternatively, the electronic processor 700 may detect a positional deviation when the difference is outside a tolerance range (e.g., a permissible error range).

When the electronic processor 700 does not detect a positional deviation (No at block 925), the electronic processor 700 may control (e.g., continue to control) the electric lift actuator 675 using the initial electric current to maintain the target lift position (at block 930). For instance, when there is not a positional deviation (i.e., "No" at block 925), then the power machine 600 (e.g., the electric lift actuator 675) has maintained the load at the target lift position (e.g., the present lift position is substantially the same or similar to the target lift position). In such instances, the initial electric current may be the same (or substantially the same) as the updated electric current. The electronic processor 700 may control the electric lift actuator 675 using the updated (or initial) electric current by controlling the power system 615 (one or more of the power sources 682) of the power machine 600 to supply the updated (or initial) electric current to the electric lift actuator 675.

When the electronic processor 700 detects a positional deviation (i.e., "Yes" at block 925), the power machine 600 (e.g., the electric lift actuator 675) has not maintained the load at the target lift position (e.g., the present lift position is different than the target lift position). When the electronic processor 700 detects a positional deviation (Yes at block 925), the electronic processor 700 may determine an updated electric current for the electric lift actuator 675 (at block 940). The updated electric current may be a change in electric current that, when supplied to the electric lift actuator 675, may return the load to the target lift position (e.g., via adjusting a lift position of the electric lift actuator 675). Thus, for example, when a deviation indicates an increase in external forces (e.g., corresponding to a downward movement of a lift assembly), the determined updated electric current may be increased over the initial electric current. In contrast, when a deviation indicates a decrease in external forces (e.g., corresponding to an upward movement of a lift assembly), the determined updated electric current may be decreased below the initial electric current.

In some configurations, the electronic processor 700 may determine the updated electric current based on the target lift position, the initial electric current, and the present lift position. In some configurations, the electronic processor 700 may determine the updated electric current based on a difference between the present lift position and the target lift position. For example, in some instances, the electronic processor 700 may determine a difference between the present lift position and the target lift position and determine the updated electric current for the electric lift actuator 675 based on the difference and the initial electric current. In some configurations, the electronic processor 700 may determine the updated electric current using a gain function that limits an acceleration of the lift assembly. Accordingly, in some configurations, the electronic processor 700 may determine the updated electric current using the following equation: Updated Electric Current=(Initial Electric Current)+ (Target Lift Position-Present Lift Position)×Gain. As generally noted above, for example, when a load moves up above the target lift position, the lift position error may be negative. This may reduce the force holding the load and, thus, the load will lower until the load reaches the target tilt position. As another example, when the load moves down below the target lift position, the error may be positive. This may increase the force holding the load and, thus, the load will rise until the load reaches the target lift position.

In some cases, the Gain noted above may be a constant value. In some cases, the gain may be a function of lift position (e.g., Gain=Function (Present Lift Position). In this regard, the gain function may return a gain that appropriately limits the acceleration of the workgroup based on present lift position. For example, as the gain increases, the acceleration increases (e.g., the higher the gain, the higher the acceleration). Further, the workgroup position (e.g., the position of the lift arm assembly, including the electric lift actuator 675) may have an effect on the amount of electric current needed to hold a given load. Accordingly, the gain function may be used to compensate for a mechanical gain of the workgroup system 620, depending on the particular geometry or operational characteristics of a particular power machine. Accordingly, a present lift position of the lift arm assembly (e.g., the electric lift actuator 675) may be passed into the gain function such that a mechanical gain of the workgroup system 620 may be compensated for.

Force control of the electric lift actuator(s) 675 allows an acceleration of the load to be managed (e.g., allows management of how quickly the load is returned to the target lift position). Accordingly, in some configurations, the amount of acceleration allowed by the ride control can be adjusted, via adjustment of the gain term (or function) discussed above. For example, if a higher speed at which the load returns to the target lift position is desired, when the amount acceleration allowed by the ride control may be increased accordingly. Alternatively, when a lower speed at which the load returns to the target lift position is desired, the amount of acceleration allowed by the ride control may be decreased accordingly.

In some instances, an operator of the power machine 600 may adjust or manage the gain (and, thereby, the acceleration) using the operator input device(s) of the power machine 600. For example, the operator may provide a variable input using a slide bar displayed via a display device (e.g., a slide bar included in a graphical user interface displayed to the operator of the power machine 600 via a display device). As another example, the operator may interact with one or more buttons (e.g., buttons included on a joystick of the power machine) to increase or decrease the acceleration of the load with each interaction with the button (e.g., each button press). For instance, when an operator interacts with (or presses) a button, the acceleration of the load may be increased or decreased by a set amount with each button press. As yet another example, the operator may interact with (e.g., rotate) a rotary dial included in an operator cab of the power machine 600. For instance, the operator may rotate the rotary dial a first direction (e.g., counter-clockwise) to decrease the acceleration and a second different direction (e.g., clockwise) to increase the acceleration. Once the operator has rotated the rotary dial to the desired acceleration amount, the operator may depress the rotary dial (similar to a button) to set the desired acceleration.

Accordingly, in some configurations, the electronic processor 700 may receive an acceleration selection (as an operator command or input) from an operator input device, where the acceleration selection indicates an amount of acceleration for returning a load to the target lift position. In response to receiving the acceleration selection, the electronic processor 700 may adjust the gain function accordingly.

Still referring to FIG. 9, during operation in ride control mode, the electronic processor 700 may control the electric lift actuator 675 using the updated electric current (at block 945). For instance, the electronic processor 700 may control the electric lift actuator 675 using the updated electric current to return to the target lift position while, e.g., the power machine 600 performs a tractive operation. For example, responsive to receiving the updated electric current, the electric lift actuator 675 may adjust the present lift position (e.g., as determined at block 920) to overcome or reduce to below an external load (as applicable), such that the electric lift actuator 675, and, the load supported thereby, returns toward the target lift position.

As illustrated in FIG. 9, in some instances, the electronic processor 700 may repeat (or recursively perform) one or more of the illustrated operations of the method 900. For example, after controlling the electric lift actuator 675 (e.g., at block 930 or 945), the method 900 may return to block 920 (represented in FIG. 9 by dashed lines 960), where the electronic processor 700 may determine a subsequent present lift position of the electric lift actuator (e.g., at block 920) and determine whether there is a positional deviation between the subsequent present lift position and the target lift position (e.g., at block 925). The electronic processor 700 may then repeat either block 930 or blocks 940 and 945.

Accordingly, in some instances, the electronic processor 700 may continuously execute one or more operations of the method 900 such that the electronic processor 700 continuously implements ride control for the power machine 600 (e.g., while the power machine 600 performs a tractive operation, while the ride control mode remains active, etc.).

In some examples, while ride control is active, an operator of the power machine 600 may want to adjust or change the target lift position (e.g., raise or lower the target lift position). For instance, while ride control is active, the operator of the power machine 600 may provide a lift command (e.g., via an operator input device, such as a joystick). The electronic processor 700 may receive the lift command from the operator input device(s). In some cases, responsive to receipt of the lift command, the electronic processor 700 may adjust the target lift position in accordance with the lift command (as an adjusted target lift position). For instance, the electronic processor 700 may repeat one or more of the steps of method 900 (e.g., block 910 and 915) to determine an adjusted target lift position (e.g., a new target lift position). For example, responsive to receiving the lift command, the electronic processor 700 may determine a present lift position of the electric lift actuator 675 (e.g., using sensor data, the lift command itself, etc.) and set the present lift position to the adjusted target lift position. The electronic processor 700 may determine an adjusted initial electric current that corresponds with holding the load at the adjusted target lift position (e.g., similar to block 915 of the method 900).

The electronic processor 700 may then execute (or otherwise provide) ride control for the power machine 600 using at least the adjusted target lift position and the adjusted initial electric current. For instance, when a positional deviation is detected (i.e., "Yes" at block 925), the electronic processor 700 may determine an updated electric current based on at least the adjusted target lift position and the adjusted initial electric current (e.g., similar to block 940 of the method 900) and control the electric lift actuator 675 using the updated electric current (e.g., similar to block 945 of the method 900). When a positional deviation is not detected (i.e., "No" at block 925), the electronic processor 700 may control the electric lift actuator 675 using the adjusted initial electric current (e.g., similar to block 930 of the method 900).

In some configurations, the electronic processor 700 may perform a load estimation process to estimate a load associated with the power machine 600 (e.g., a weight of the work element 655, contents of the work element 655, overall weight of a lift arm assembly as supported/moved by an actuator, etc.). In some cases, load estimates can be used to influence the ride control gain discussed above. For instance, in some configurations, the electronic processor 700 may tune or adjust performance of the ride control based on, e.g., the amount of load in the work element 655 (or the work element 655 itself when there is no material in the work element 655). In other cases, load estimation can alternatively (or additionally) be used for other purposes.

In some examples, the electronic processor 700 may determine an estimated weight for a load of the power machine 600. The electronic processor 700 may determine the estimated weight based on the initial electric current and a present or target lift position. The electronic processor 700 may then determine the updated electric current for the electric lift actuator based on the estimated weight for the load of the power machine 600. In some instances, the electronic processor 700 may determine the updated electric current by tuning or otherwise adjusting the gain function and using the adjusted gain function to determine the updated electric current. In this regard, particular tuning or other adjustment can be determined and implemented based on the particular geometry of a particular lift arm assembly of a particular power machine.

Figure 10:
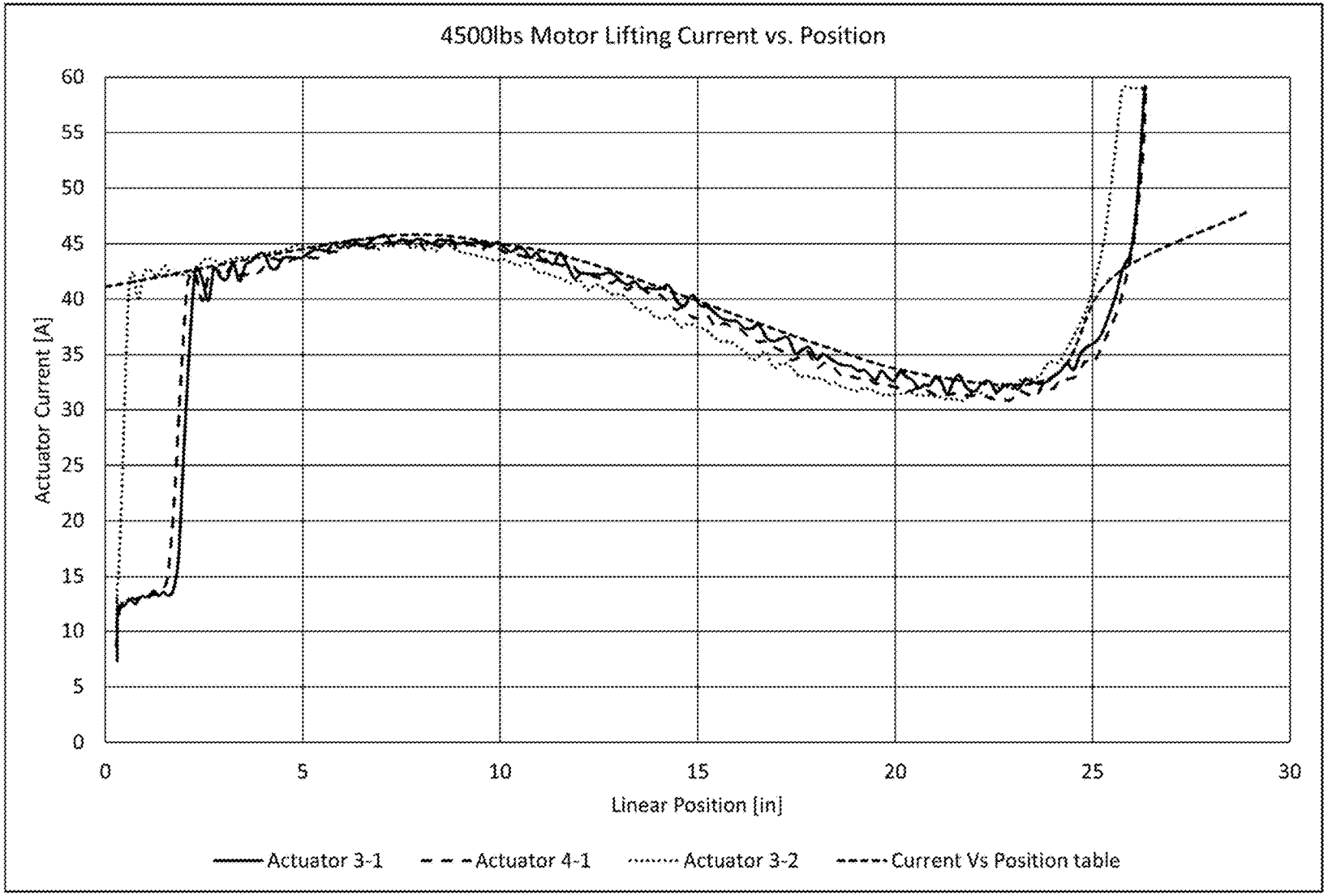
FIG. 10 is a graph of electric current and linear position as a 4500 lb. load is moved through a stroke of a lift arm according to some configurations.

FIG. 10 is a graph 1000 illustrating a relationship between electric current and linear position as a 4500 lb. load is moved through a stroke of the lift arm 670. The amount of force needed to hold the load at a given position of the electric lift actuator 675 varies. For instance, as illustrated in the graph 1000, as the linear position increases, the electric current to hold the load varies. The mechanical gain of the lift arm 670 is relatively high close to a retracted length of the lift arm 670 to, e.g., optimize an amount of breakout force(s) available when the lift arm 670 is retracted. Accordingly, load estimation may be inaccurate in such a high gain region. Therefore, to maintain accurate load estimation, a region of stroke in the electric lift actuator 675 may be limited, such as, e.g., to regions where gain is not experiencing a rapid change. With reference to FIG. 10, the region of stroke in the electric lift actuator 675 may be limited to between 4 and 23 inches (e.g., where the gain is not rapidly changing).

Figure 11:
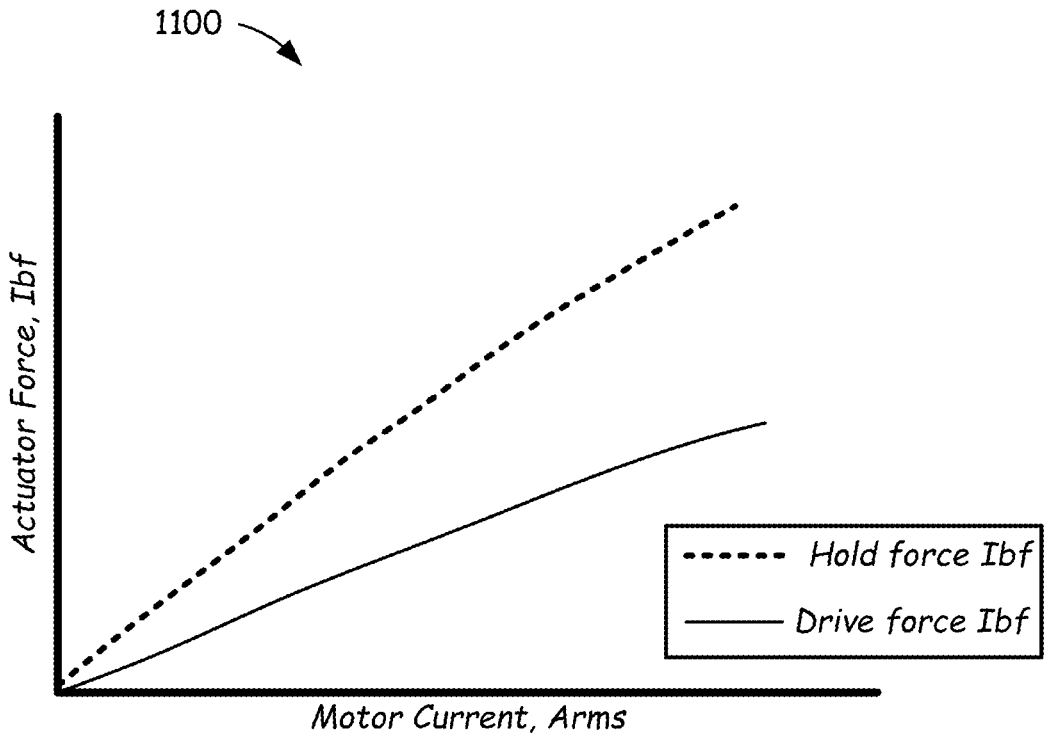
FIG. 11 is a graph of force and electric current of an electric lift actuator according to some configurations.

In some configurations, the electronic processor 700 may compute (or otherwise determine) a computational estimate of the load using the lift arm geometry of the lift arm 670, the lift position of the lift arm geometry (e.g., via a length of the electric lift actuator 675), and a relationship between the force and electric current of the electric lift actuator 675. For example, FIG. 11 is a graph 1100 illustrating a relationship between the force and the electric current of the electric lift actuator 675.

Figure 13:
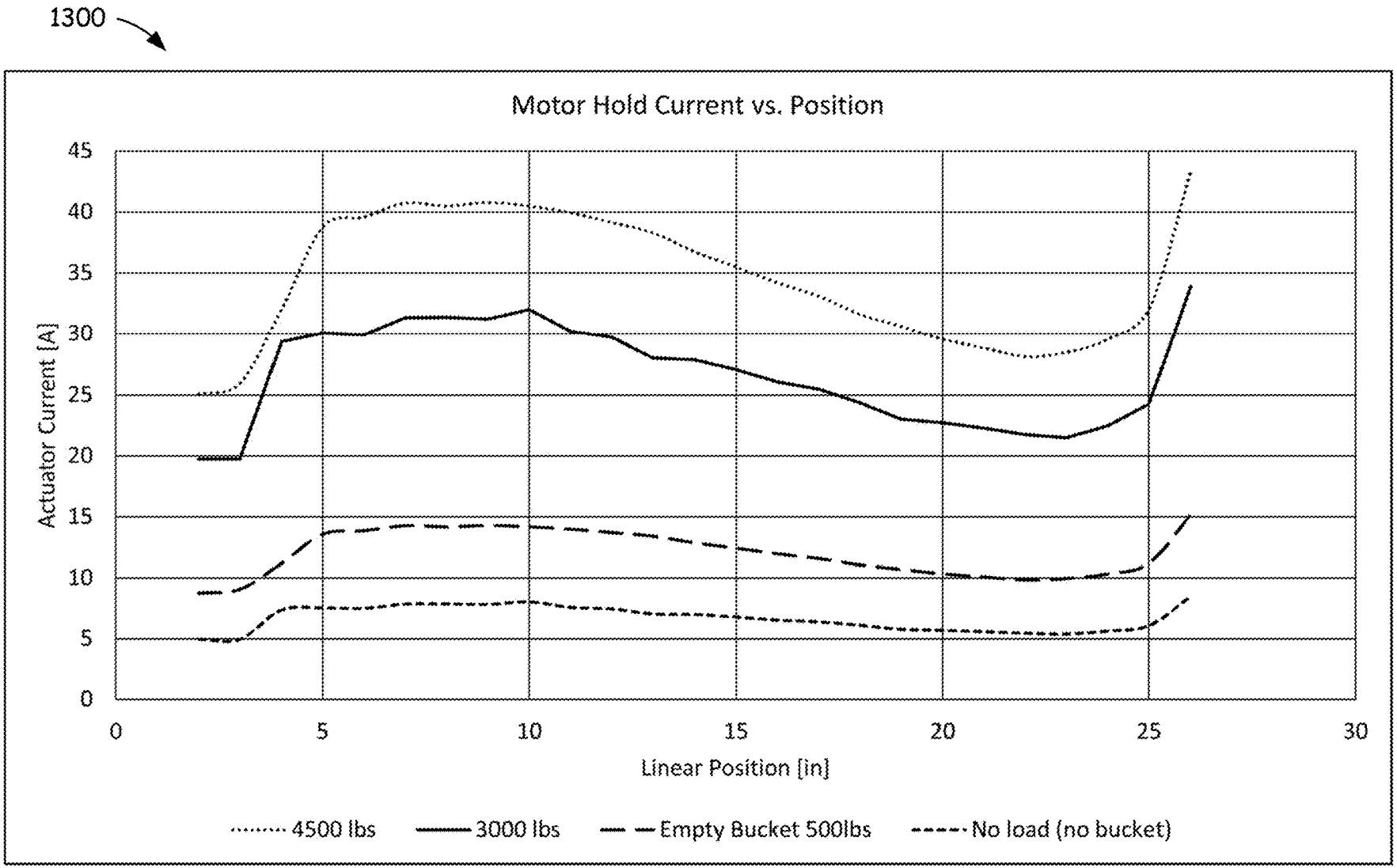
FIG. 13 a graph of the electric current measurements for various loads at different lift positions using the table of FIG. 12 according to some configurations.

Alternatively, or in addition, the electronic processor 700 may use a mapping (e.g., a look up table) to determine a load on the workgroup system 620 (e.g., the lift arm assembly or component(s) thereof). For example, FIG. 12 illustrates a table 1200 of electric current measurements for various loads at different lift positions. In some configurations, a load estimate may be interpolated from electric currents and electric lift actuator lengths (e.g., the electric currents and electric lift actuator lengths included in the table 1200). For example, FIG. 13 is a graph 1300 of the electric current measurements for various loads at different lift positions using the table 1200.

Unless otherwise specified or limited, the terms "about" and "approximately," as used herein with respect to a reference value, refer to variations from the reference value of +15% or less, inclusive of the endpoints of the range. Similarly, the term "substantially," as used herein with respect to a reference value, refers to variations from the reference value of +5% or less, inclusive of the endpoints of the range.

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of." For example, a list of "one of A, B, or C" indicates options of: A, but not B and C; B, but not A and C; and C, but not A and B. A list preceded by "one or more" (and variations thereon) and including "or" to separate listed elements indicates options of one or more of any or all of the listed elements.

For example, the phrases "one or more of A, B, or C" and "at least one of A, B, or C" indicate options of: one or more A; one or more B; one or more C; one or more A and one or more B; one or more B and one or more C; one or more A and one or more C; and one or more of A, one or more of B, and one or more of C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C.

In some embodiments, aspects of the technology disclosed herein, including computerized implementations of methods according to the technology disclosed herein, can be implemented as a system, method, apparatus, or article of manufacture using standard programming or engineering techniques to produce software, firmware, hardware, or any combination thereof to control a processor device (e.g., a serial or parallel general purpose or specialized processor chip, a single- or multi-core chip, a microprocessor, a field programmable gate array, any variety of combinations of a control unit, arithmetic logic unit, and processor register, and so on), a computer (e.g., a processor device operatively coupled to a memory), or another electronically operated controller to implement aspects detailed herein. Accordingly, for example, embodiments of the technology disclosed herein can be implemented as a set of instructions, tangibly embodied on a non-transitory computer-readable media, such that a processor device can implement the instructions based upon reading the instructions from the computer-readable media. Some embodiments of the technology disclosed herein can include (or utilize) a control device such as an automation device, a special purpose or general purpose computer including various computer hardware, software, firmware, and so on, consistent with the discussion below. As specific examples, a control device can include a processor, a microcontroller, a field-programmable gate array, a programmable logic controller, logic gates etc., and other typical components that are known in the art for implementation of appropriate functionality (e.g., memory, communication systems, power sources, user interfaces and other inputs, etc.). In some embodiments, a control device can include a centralized hub controller that receives, processes and (re) transmits control signals and other data to and from other distributed control devices (e.g., an engine controller, an implement controller, a drive controller, etc.), including as part of a hub-and-spoke architecture or otherwise.

The term "article of manufacture" as used herein is intended to encompass a computer program accessible from any computer-readable device, carrier (e.g., non-transitory signals), or media (e.g., non-transitory media). For example, computer-readable media can include but are not limited to magnetic storage devices (e.g., hard disk, floppy disk, magnetic strips, and so on), optical disks (e.g., compact disk (CD), digital versatile disk (DVD), and so on), smart cards, and flash memory devices (e.g., card, stick, and so on). Additionally, it should be appreciated that a carrier wave can be employed to carry computer-readable electronic data such as those used in transmitting and receiving electronic mail or in accessing a network such as the Internet or a local area network (LAN). Those skilled in the art will recognize that many modifications may be made to these configurations without departing from the scope or spirit of the claimed subject matter.

Certain operations of methods according to the technology disclosed herein, or of systems executing those methods, may be represented schematically in the FIGS. or otherwise discussed herein. Unless otherwise specified or limited, representation in the FIGS. of particular operations in particular spatial order may not necessarily require those operations to be executed in a particular sequence corresponding to the particular spatial order. Correspondingly, certain operations represented in the FIGS., or otherwise disclosed herein, can be executed in different orders than are expressly illustrated or described, as appropriate for particular embodiments of the technology disclosed herein. Further, in some embodiments, certain operations can be executed in parallel, including by dedicated parallel processing devices, or separate computing devices configured to interoperate as part of a large system.

As used herein in the context of computer implementation, unless otherwise specified or limited, the terms "component," "system," "module," "block," and the like are intended to encompass part or all of computer-related systems that include hardware, software, a combination of hardware and software, or software in execution. For example, a component may be, but is not limited to being, a processor device, a process being executed (or executable) by a processor device, an object, an executable, a thread of execution, a computer program, or a computer. By way of illustration, both an application running on a computer and the computer can be a component. One or more components (or system, module, and so on) may reside within a process or thread of execution, may be localized on one computer, may be distributed between two or more computers or other processor devices, or may be included within another component (or system, module, and so on).

Also as used herein, unless otherwise limited or defined, "substantially parallel" indicates a direction that is within ±12 degrees of a reference direction (e.g., within ±6 degrees or ±3 degrees), inclusive. Correspondingly, "substantially vertical" indicates a direction that is substantially parallel to the vertical direction, as defined relative to the reference system (e.g., for a power machine, as defined relative to a horizontal support surface on which the power machine is operationally situated), with a similarly derived meaning for "substantially horizontal" (relative to the horizontal direction). Similarly, as used herein, unless otherwise limited or defined, "substantially perpendicular" indicates a direction that is within ±12 degrees of perpendicular a reference direction (e.g., within ±6 degrees or ±3 degrees), inclusive.

Also as used herein, unless otherwise limited or defined, "current" is generally used as a temporal measure, i.e., to indicate a present value (e.g., a present position, load, etc.). In contrast, "electric current" is used to refer to the flow of electric charge in electric systems.

Although the technology disclosed herein has been described with reference to preferred embodiments, workers skilled in the art will recognize that changes may be made in form and detail to the disclosed embodiments without departing from the spirit and scope of the concepts discussed herein.

What is claimed is:

1. A system for controlling an electric power machine, the system comprising:

one or more electronic processors in electrical communication with an electric lift actuator of a lift assembly of the electric power machine and configured to:

receive operational data for the electric power machine;

determine, based on the operational data, a target lift position for the electric lift actuator;

determine, based on the operational data, an initial electric current of the electric lift actuator corresponding to the target lift position;

determine, based on the operational data, a present lift position of the electric lift actuator;

determine an updated electric current for the electric lift actuator based on the target lift position, the initial electric current, and the present lift position; and control the electric lift actuator using the updated electric current, to maintain or return to the target lift position while the electric power machine performs a tractive operation.

2. The system of claim 1, wherein the present lift position differs from the target lift position; and wherein, responsive to receiving the updated electric current, the electric lift actuator returns to the target lift position.

3. The system of claim 1, wherein the one or more electronic processors are configured to determine the updated electric current for the electric lift actuator using a gain function that limits an acceleration of the lift assembly.

4. The system of claim 3, wherein the one or more electronic processors are configured to:

adjust the gain function based on operator input provided via an operator input device of the electric power machine.

5. The system of claim 1, wherein the one or more electronic processors are configured to:

determine a difference between the present lift position and the target lift position; and determine the updated electric current for the electric lift actuator based on the difference and the initial electric current.

6. The system of claim 1, wherein the one or more electronic processors are configured to:

responsive to receipt of a lift command from an operator input device of the electric power machine, adjust the target lift position based on the lift command as an adjusted target lift position;

determine the updated electric current based on the adjusted target lift position; and control the electric lift actuator using the updated electric current such that the electric lift actuator maintains or returns to the adjusted target lift position.

7. A method for controlling an electric power machine, the method comprising:

upon activation of a ride control mode for the electric power machine:

determining, with one or more electronic processors, a target lift position for a lift assembly of the electric power machine;

determining, with the one or more electronic processors, an initial electric current of the lift assembly for the target lift position; and determining, with the one or more electronic processors, a present lift position of the lift assembly;

determining, with the one or more electronic processors, an updated electric current for an electric lift actuator of the lift assembly, based on the target lift position, the initial electric current, and the present lift position; and controlling, with the one or more electronic processors, the electric lift actuator using the updated electric current to maintain the target lift position.

8. The method of claim 7, further comprising:

receiving, with the one or more electronic processors, from an operator input device of the electric power machine, a request to activate the ride control mode for the electric power machine, and responsive to receiving the request, activating, with the one or more electronic processors, the ride control mode for the electric power machine.

9. The method of claim 7, further comprising:

prior to activation of the ride control mode for the electric power machine, controlling, with the one or more electronic processors, the electric lift actuator based on velocity.

10. The method of claim 7, further comprising:

detecting, with the one or more electronic processors, an activation condition, the activation condition triggering activation of the ride control mode for the electric power machine; and responsive to detecting the activation condition, activating, with the one or more electronic processors, the ride control mode for the electric power machine.

11. The method of claim 10, wherein detecting the activation condition includes:

determining, with the one or more electronic processors, whether a present speed of the electric power machine satisfies a speed threshold; and when the present speed of the electric power machine satisfies the speed threshold:

detecting, with the one or more electronic processors, the activation condition; and activating, with the one or more electronic processors, the ride control mode for the electric power machine.

12. The method of claim 10, wherein detecting the activation condition includes:

determining, with the one or more electronic processors, whether a present lift position of the lift assembly satisfies a position threshold; and when the present lift position of the lift assembly satisfies the position threshold:

detecting, with the one or more electronic processors, the activation condition; and activating, with the one or more electronic processors, the ride control mode for the electric power machine.

13. The method of claim 11, wherein detecting the activation condition includes:

determining, with the one or more electronic processors, whether the lift assembly is stationary; and when the lift assembly is stationary:

detecting, with the one or more electronic processors, the activation condition; and activating, with the one or more electronic processors, the ride control mode for the electric power machine.

14. The method of claim 7, wherein determining the updated electric current for the electric lift actuator includes:

determining, with the one or more electronic processors, based on the initial electric current and the target lift position, an estimated weight for a load of the electric power machine; and determining, with the one or more electronic processors, the updated electric current for the electric lift actuator based on the estimated weight for the load of the electric power machine.

15. The method of claim 7, wherein determining, with the one or more electronic processors, the updated electric current for an electric lift actuator of the lift assembly includes determining the updated electric current for the electric lift actuator of the lift assembly using a gain function that limits an acceleration of the lift assembly.

16. An electric power machine, the electric power machine comprising:

a frame;

a plurality of electric actuators supported by the frame, wherein the plurality of electric actuators includes an electric lift actuator;

a lift arm structure that includes:

a lift arm coupled to the frame and configured to be moved relative to the frame by the electric lift actuator;

an electric power source configured to power the plurality of electric actuators; and one or more electronic processors in communication with the plurality of electric actuators, the one or more electronic processors configured to:

monitor operational data for the electric power machine, the operational data including data associated with a first control parameter and a second control parameter;

control the electric lift actuator using a first control parameter when a first operation mode is active;

detect activation of a ride control mode for maintaining or returning to a target lift position during tractive operations; and responsive to activation of the ride control mode for the electric power machine, control the electric lift actuator to maintain or return to the target lift position using the second control parameter while the electric power machine performs a tractive operation, the second control parameter being different from the first control parameter.

17. The electric power machine of claim 16, wherein the first control parameter is a velocity control parameter.

18. The electric power machine of claim 16, wherein the second control parameter is an electric current control parameter.

19. The electric power machine of claim 18, wherein the one or more electronic processors are configured to:

upon activation of the ride control mode:

monitor the operational data to detect positional deviations from the target lift position; and when a positional deviation from the target lift position is detected, determine an amount of positional deviation from the target lift position;

determine an updated electric current for the electric lift actuator based on the initial electric current and the amount of positional deviation from the target lift position; and control the electric lift actuator using the updated electric current to return the electric lift actuator to the target lift position.

20. The electric power machine of claim 16, wherein the one or more electronic processors are configured to control the electric lift actuator using the second control parameter by:

determining, based on the operational data, a target lift position for the electric lift actuator; and determining, based on the operational data, an initial electric current of the electric lift actuator for the target lift position, wherein the electric lift actuator is controlled based on the target lift position and the initial electric current.

* * * * *